US005393051A

United States Patent [19]

Merino et al.

[11] Patent Number: 5,393,051

[45] Date of Patent: Feb. 28, 1995

[54] ADJUSTABLE NET

[75] Inventors: Darrell Merino, Newburyport, Mass.; James Thibault, Portland, Me.

[73] Assignee: Forster Inc., Portland, Me.

[21] Appl. No.: 906,923

[22] Filed: Jun. 30, 1992

[51] Int. Cl.[6] ..... A63B 61/00

[52] U.S. Cl. ..... 273/29 B

[58] Field of Search ..... 273/29 B, 29 BA, 411

[56] References Cited

U.S. PATENT DOCUMENTS

| | | | |
|---|---|---|---|
| 2,052,637 | 9/1936 | Lichtenstein | 273/29 B |
| 3,649,011 | 3/1972 | Barnes | 273/29 B |
| 3,951,406 | 4/1976 | Rock . | |
| 4,140,313 | 2/1979 | Martin . | |
| 4,192,503 | 3/1980 | Karas . | |
| 4,243,221 | 1/1981 | Ferreira-Godinho . | |
| 4,895,366 | 1/1990 | Bartasius . | |
| 4,973,055 | 11/1990 | Muir | 273/29 BA |
| 4,973,059 | 11/1990 | Stewart . | |
| 4,993,719 | 2/1991 | Hernandez . | |
| 5,048,844 | 9/1991 | Haseltine . | |
| 5,052,686 | 10/1991 | Pryor | 273/29 B |
| 5,058,899 | 10/1991 | Jackson | 273/29 B |

FOREIGN PATENT DOCUMENTS

| | | | |
|---|---|---|---|
| 0340027 | 11/1989 | European Pat. Off. . | |
| 562073 | 11/1923 | France | 273/29 B |
| 2533966 | 2/1977 | Germany . | |
| 21006 | 9/1911 | United Kingdom | 273/29 B |
| 190006 | 12/1922 | United Kingdom | 273/29 B |
| 237130 | 7/1925 | United Kingdom | 273/29 B |

*Primary Examiner*—Theatrice Brown

*Attorney, Agent, or Firm*—Sandler, Greenblum & Bernstein

[57] ABSTRACT

An adjustable net includes sections which are adapted to overlap and fastening elements which hold such overlapping portions to shorten the length of the net. In another embodiment a detachable sleeve is movable along the length of the net to set the overall length of the net. Also, a plurality of sleeves may be selectively placed over net posts to determine the length of the net. In another embodiment, the net may be rolled on a rotatable net post.

8 Claims, 24 Drawing Sheets

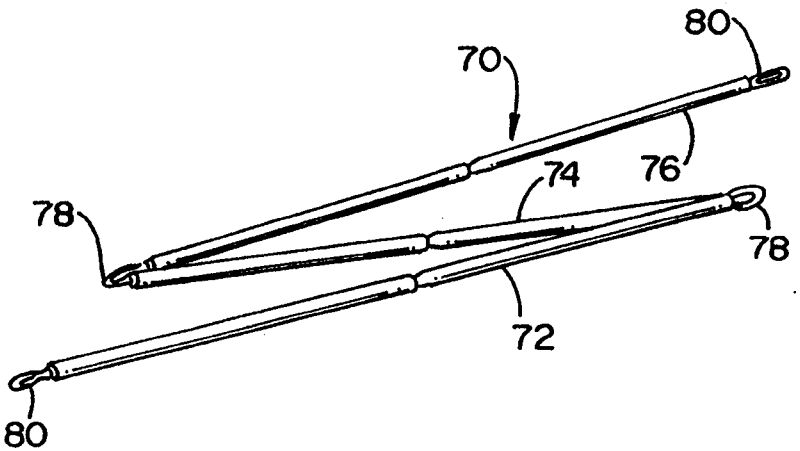
FIG. 4
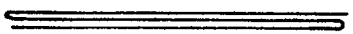
FIG. 3C
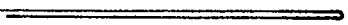
FIG. 3B
FIG. 3A
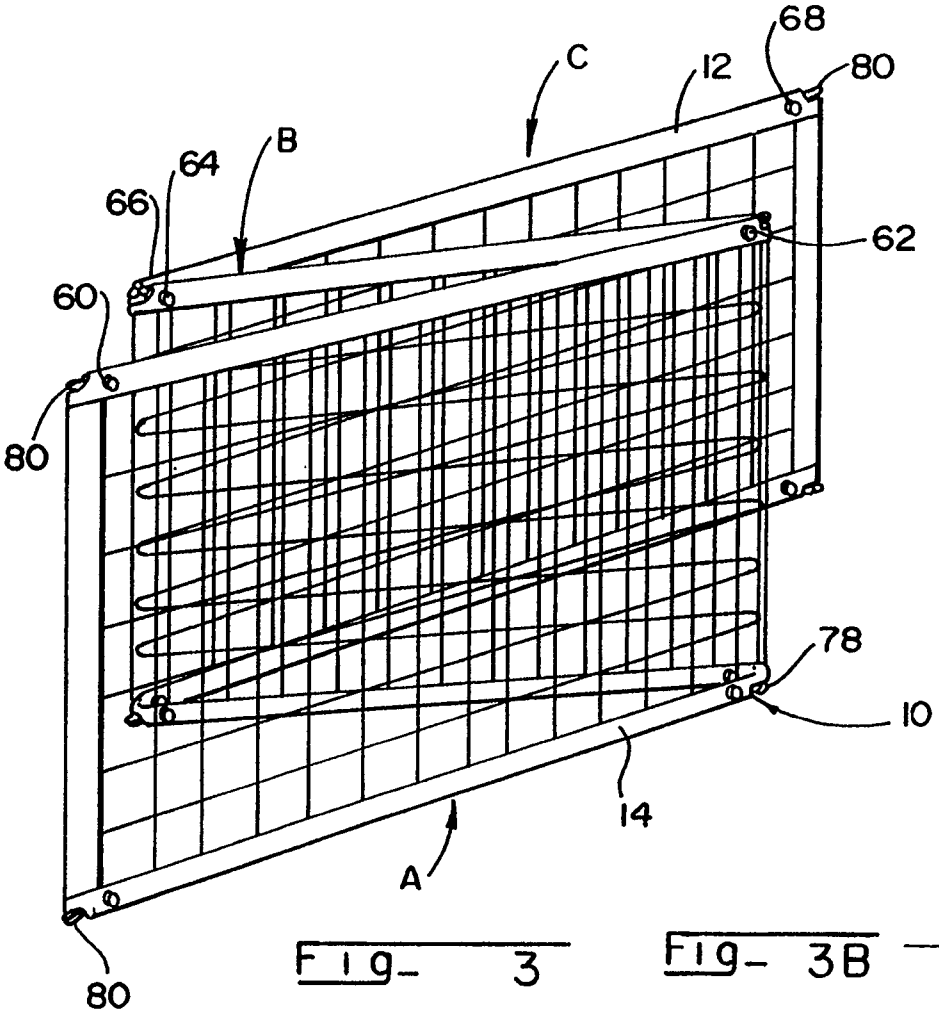
FIG. 3

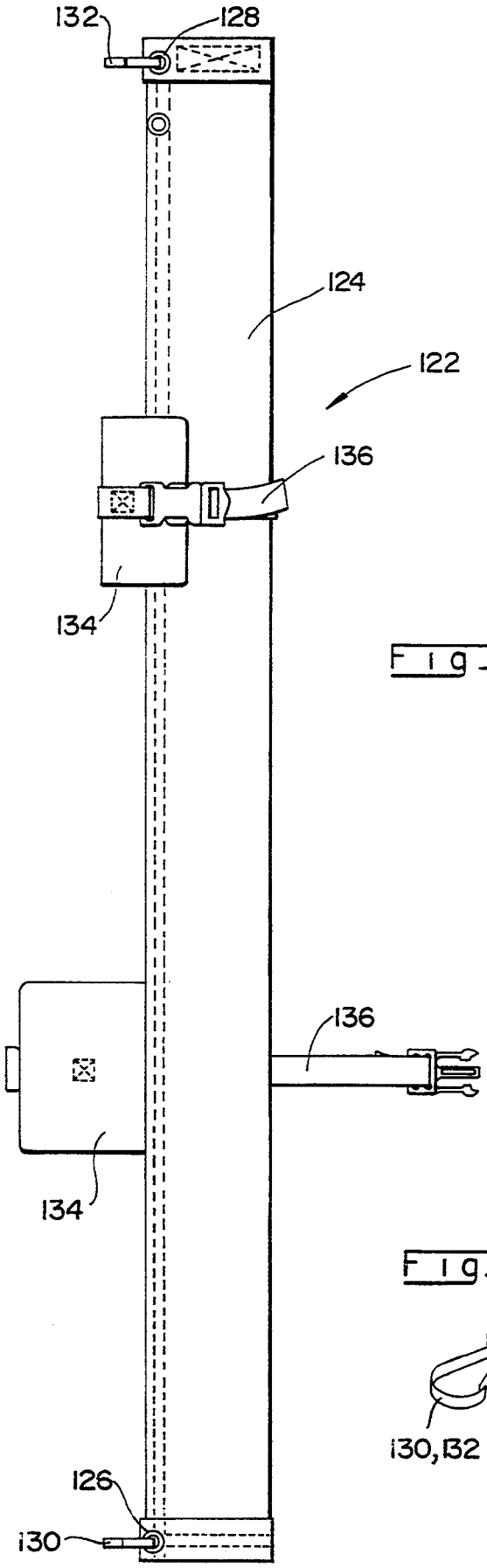
Fig- 11
Fig- 11A
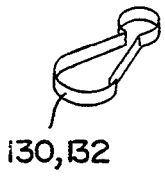

12
206
204
20
10
210
208

217
217a
217c
217b
20

217
20

216
214
212

12
10
202
204
20
202
204

ADJUSTABLE NET

BACKGROUND OF THE INVENTION

1. Field of the Invention

The present invention relates to an adjustable net usable in racket and/or ball games, such as volleyball, tennis, and badminton.

2. Description of Background and Relevant Information

Various nets having adjustable lengths have been proposed. Examples are described in German Patent No. 2,533,966 and European Patent Application No. 0 340 227.

German Patent No. 2,533,966 discloses a net having an adjustable frame, which is adjustable in length by turnbuckles, however, there is no provision for storing or keeping any excess net material out of the way when the net is shortened in length.

European Patent Application No. 0 340 027 discloses an adjustable net structure in which a frame is formed from a plurality of tubular members so that the dimensions of the support assembly can be varied. However, there is no provision for varying the length of the net so that excess net material is out of the way.

KARAS, U.S. Pat. No. 5,192,503, discloses a tennis serving cage, where the side walls are foldable against an end wall for storage and transport; however, there is no provision for adjusting the length of the net when in an operative mode.

HERNANDEZ, U.S. Pat. No. 4,993,719, discloses a portable self-contained volleyball net, wherein the net is stored on reels in two housings; however, there is no provision for adjusting the length of the net while being used.

STEWART, U.S. Pat. No. 4,973,059, discloses a sleeve for attaching a net to a net post.

SUMMARY OF THE INVENTION

According to the present invention, a net for volleyball and other games is adjustable in length in a very simple manner, wherein excess net material resulting from shortening the net is conveniently out of the way of the progress of the game.

According to one aspect of the invention, an adjustable net for attachment to external net supports, includes an elongated net having a fully extended length, a top edge and a bottom edge, a first side edge and a second side edge. The net supports may be net posts. The net is divided into at least two sections in the longitudinal direction, each section including an edge portion. Fastening elements are located at the edge portions of each of the sections, whereby one of the at least two sections may overlap another of the at least two sections, and be fastened thereto by the fastening elements to shorten the fully extended length of the net.

The fastening elements comprise grommets on at least one of the top edge and the bottom edge of the net, and a fastening means extending through respective fastening elements.

According to another aspect of the invention, at least one fastening element at an edge portion includes two grommets, the fastening means extending through the two grommets.

A sleeve may be located at one or both of the first side edge and the second side edge, the sleeve being adapted to extend around a respective external net post.

The adjustable net may further include at least one auxiliary sleeve at an edge portion of a section of the net, and may further include a fastening element at least one auxiliary sleeve. The fastening element may include at least one string or at least one strap, wherein the strap is readily detachable.

According to another aspect of the present invention an adjustable net for attachment to external net posts, includes an elongated net having a fully extended length, a top edge and a bottom edge, a first side edge and a second side edge, and a first attachment element at the first side edge for attachment to an external net post. A second attachment element is selectively attachable at the second side edge and at different positions along the length of the net, the second attachment element being attachable to an external net post. The second attachment element includes a sleeve, the sleeve being adapted to extend around an external net post. At least one fastening element is located on the second attachment element to hold excess net when the second attachment element is at one of the different positions along the length of the net and includes at least one net strap. The second attachment element may include a sleeve, the sleeve being adapted to extend around an external net post. The fastening elements include grommets on at least one of the top edge and the bottom edge of the net, and a fastening means attached to the second attachment element for extending through a respective grommet. The fastening means may comprise a snap hook.

According to another aspect of the present invention, the adjustable net includes an elongated net having a fully extended length, a top edge and a bottom edge, a first side edge and a second side edge, and a first attachment element at the first side edge for attachment to the first external net post. The second external net post is rotatable for winding the net thereon. A second attachment element at the second external net post is attached to the second side edge. The second attachment element includes at least one guide element for facilitating even rolling of the net on the second external net post.

The adjustable net includes a plurality of horizontal and vertical elements which form openings, and each of the guide elements includes at least one arm for extending into the openings.

The adjustable net also includes a double 0-ring having two connected rings, one of the rings being connected to the second external net post and the other of the rings being connected to the bottom edge of the net.

BRIEF DESCRIPTION OF THE DRAWINGS

The invention is further explained in the description which follow with reference to the drawings illustrating, by way of non-limiting examples, various embodiments of the invention wherein:

FIG. 3 is a perspective view of a third embodiment of the adjustable net of the present invention;

FIG. 3A–3C are diagrammatical views, illustrating various configurations of the adjustable net of FIG. 3;

FIG. 4 illustrates a tension line useable in the embodiment of FIG. 3;

FIG. 11 illustrates a detachable sleeve useable with the net of FIG. 10;

DETAILED DESCRIPTION OF THE PREFERRED EMBODIMENTS

The various embodiments of the adjustable net of the present invention are described below with reference to the figures, wherein like elements are referred to by the same reference number. Also, the length of the fully extended net is described as being 30 feet; however, any fully extended length may be used.

Figures 1, 1A, 1B, 1C, 1D, 1E, 1F:
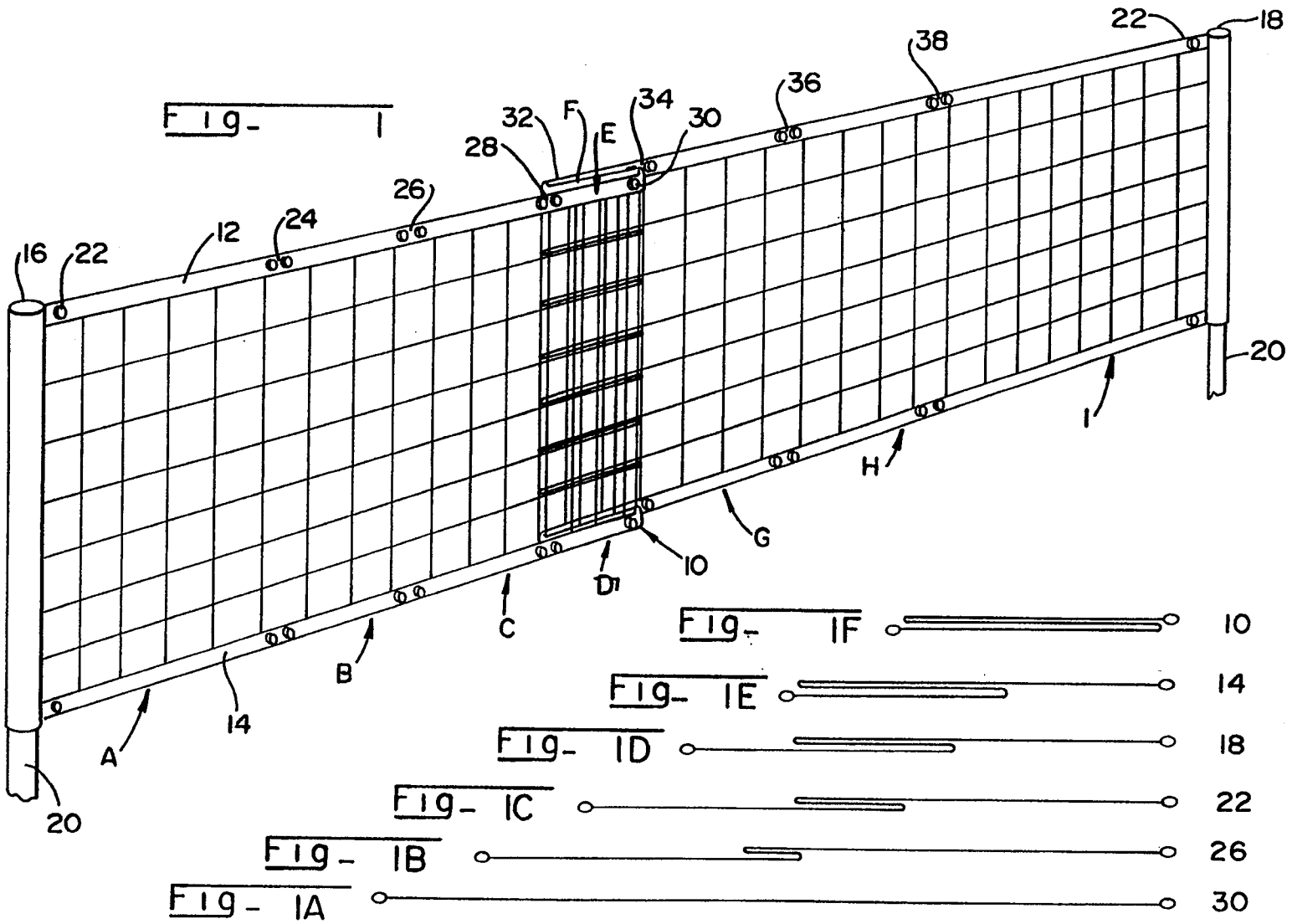
FIG. 1 is a perspective view of a first embodiment of the adjustable net of the present invention.
FIGS. 1A–1F are diagrammatical views, illustrating various configurations of the present invention.

Referring initially to FIG. 1, net 10 includes the typical mesh construction of horizontal and vertical elements. Net 10 includes a top tape 12 and a bottom tape 14. Sleeves 16 and 18 are attached to respective ends of net 10 for attachment over typical net posts, which are illustrated schematically at 20. The sleeves may be made of flexible textile or plastic materials, such as vinyl or nylon. The net is divided into sections A-I, which are divided by grommets on top tape 12 and bottom tape 14, respectively. For example, sections A and I are each approximately 8 feet in length, and sections B-H are each approximately 2 feet in length.

Grommets are included on top tape 12 and bottom tape 14 to delineate the edges of the respective sections. To simplify the description, only the arrangement of the grommets on the top tape will be described, since the same description applies to the corresponding grommets on the bottom tape.

Sections A and I each include a respective grommet 22 adjacent sleeves 16 and 18. Referring to FIG. 1, pairs of grommets 24, 26, 28, 30, 32, 34, 36, and 38 are provided at the right edges of sections A, B, C, D, E, F, G, and H, respectively. Each grommet is adapted to receive a not shown fastening element, such as a pin, bolt or snap fastener, through an opening therein.

The operation for adjusting the length of net 10 is illustrated in FIGS. 1A–1F. In this example, the net is illustrated as having a length of 30 feet.

As shown in FIG. 1A, the net is fully extended and accordingly has a length of 30 feet. FIG. 1B corresponds to the arrangement illustrated in FIG. 1 wherein the net has a length of approximately 26 feet. Net 10 is folded so that sections D, E, and F are substantially overlapped. A fastening element extends through one of the pair of grommets 28, and then through both grommets of pair 32 (which are aligned with each other since sections E and F are folded and overlap). Another fastening element extends through both of the pair of grommets 30 and one of the pair of grommets 34.

In FIG. 1C, sections B and C overlap sections D and E, and also overlap sections F and G to form a net of approximately 22 feet in length. The fastening elements extend through the respective grommets as described above.

FIGS. 1D and 1E illustrate sections overlapping in a similar manner so that the length of the net is 18 and 14 feet, respectively. FIG. 1F illustrates the net being folded in thirds so that the overall length of the net is 10 feet. The fastening elements extend through the respective grommets in a similar manner as described with respect to FIG. 1B.

Figure 2:
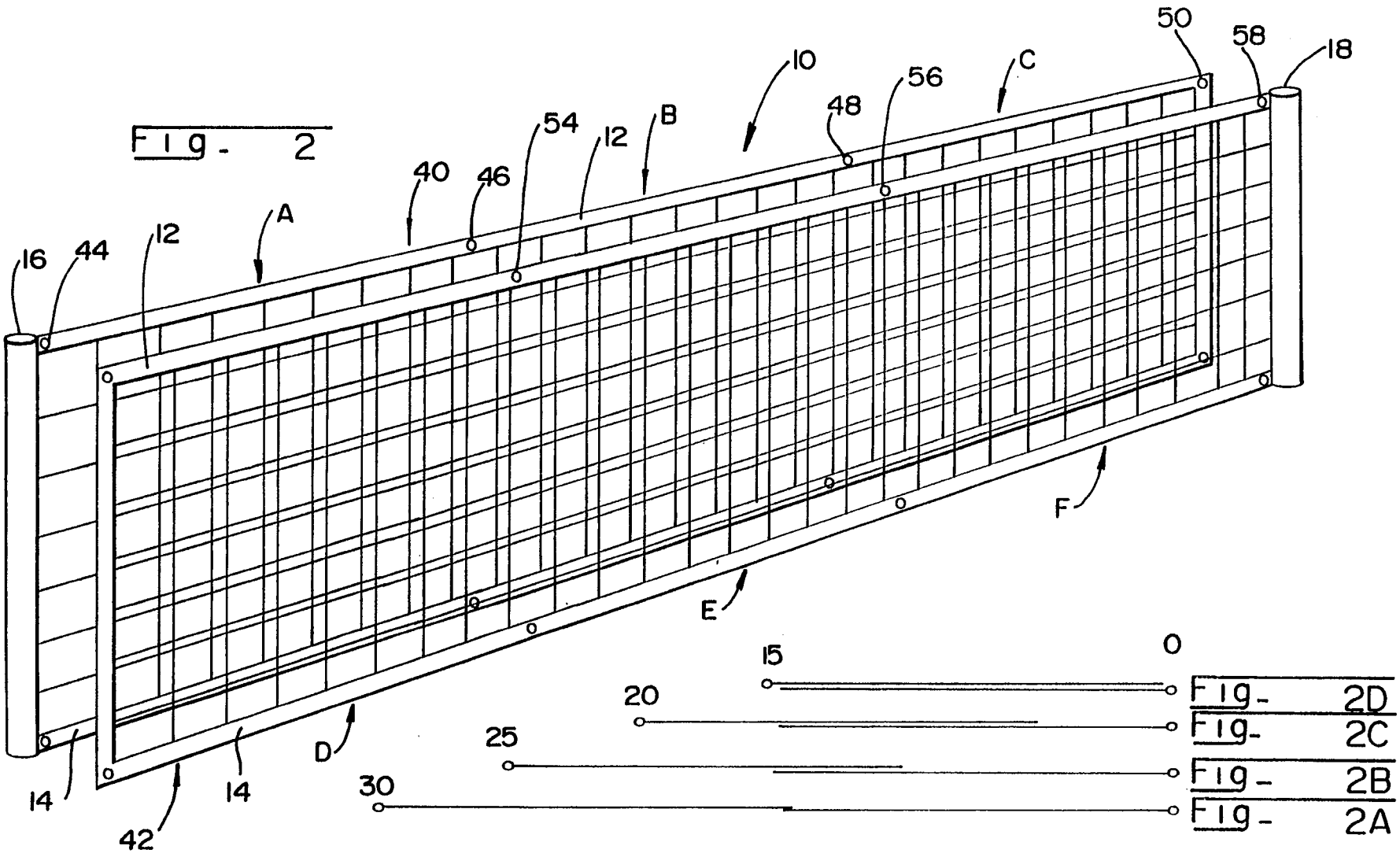
FIGS. 2A–2D are diagrammatical views, illustrating various configurations of the adjustable net of FIG. 2.

A second embodiment of adjustable net 10 of the present invention is illustrated in FIG. 2. Net 10 includes two half-nets 40 and 42. Half-net 40 includes sections A, B, and C, and half-net 42 includes sections D, E, and F. In this example, each of the sections may have a length of 5 feet; however, any length may be used. Half-nets 40 and 42 include sleeves 16 and 18, respectively, at their outer ends. Half-net 40 includes grommets 44, 46, 48, and 50, and half-net 42 includes grommets 52, 54, 56, and 58. To simply the explanation only the grommets on top tapes 12 are described, while bottom tapes 14 may include corresponding grommets.

As illustrated in FIG. 2A, when a fastening element extends through grommets 50 and 52 the net has an overall length of 30 feet.

As illustrated in FIG. 2B, when a fastening element extends through openings 50 and 54 and another fastening element extends through openings 52 and 48, the net has an overall length of 25 feet. Similarly, as illustrated in FIG. 2, if a fastening element extends through openings 50 and 56 an another fastening element extends through openings 52 and 46, the net has an overall length of 20 feet.

As illustrated in FIG. 2D, when both half-nets 40 and 42 substantially overlap, and a fastening element extends through openings 50 and 58, and another fastening element extends through openings. 52 and 44, the net has an overall length of 15 feet.

A third embodiment of the adjustable net of the present invention is illustrated in FIGS. 3, 3A–3C, and 4. As illustrated in FIG. 3, net 10 includes three sections A, B, and C, which may each, for example, be 10 feet in length. Section A includes grommets 60 and 62 on the top tape; section B includes grommet 64 and a not shown grommet behind grommet 62; section C includes grommets 66 and 68.

As illustrated in FIG. 4, a tension line 70 includes sections 72, 74,. and 76, which substantially correspond to sections A, B, and c, respectively. Sections 72, 74, and 76 may be made of a rigid material such as fiberglass. The sections are connected together by elastic elements 78, so that the tension line may be folded as illustrated in FIG. 4. Tension lines 70 are adapted to be inserted in respective top tapes 12 and bottom tapes 14, so that net 10 may fold as illustrated in FIG. 3.

As illustrated in FIG. 3A, when the net is fully extended, it has a length of 30 feet. As illustrated in FIG. 3B, when one section (e.g., section C) is folded over and fastened to section B by fastening elements extending through respective grommets, as described above, the net has an overall length of 20 feet. When all three sections are folded, as illustrated in FIG. 3C, and fastening elements extending through the respective grommets, the net has an overall length of 10 feet.

Net 10 may be attached to net posts through attachment elements 80 at the ends of tension lines 70.

Figure 5:
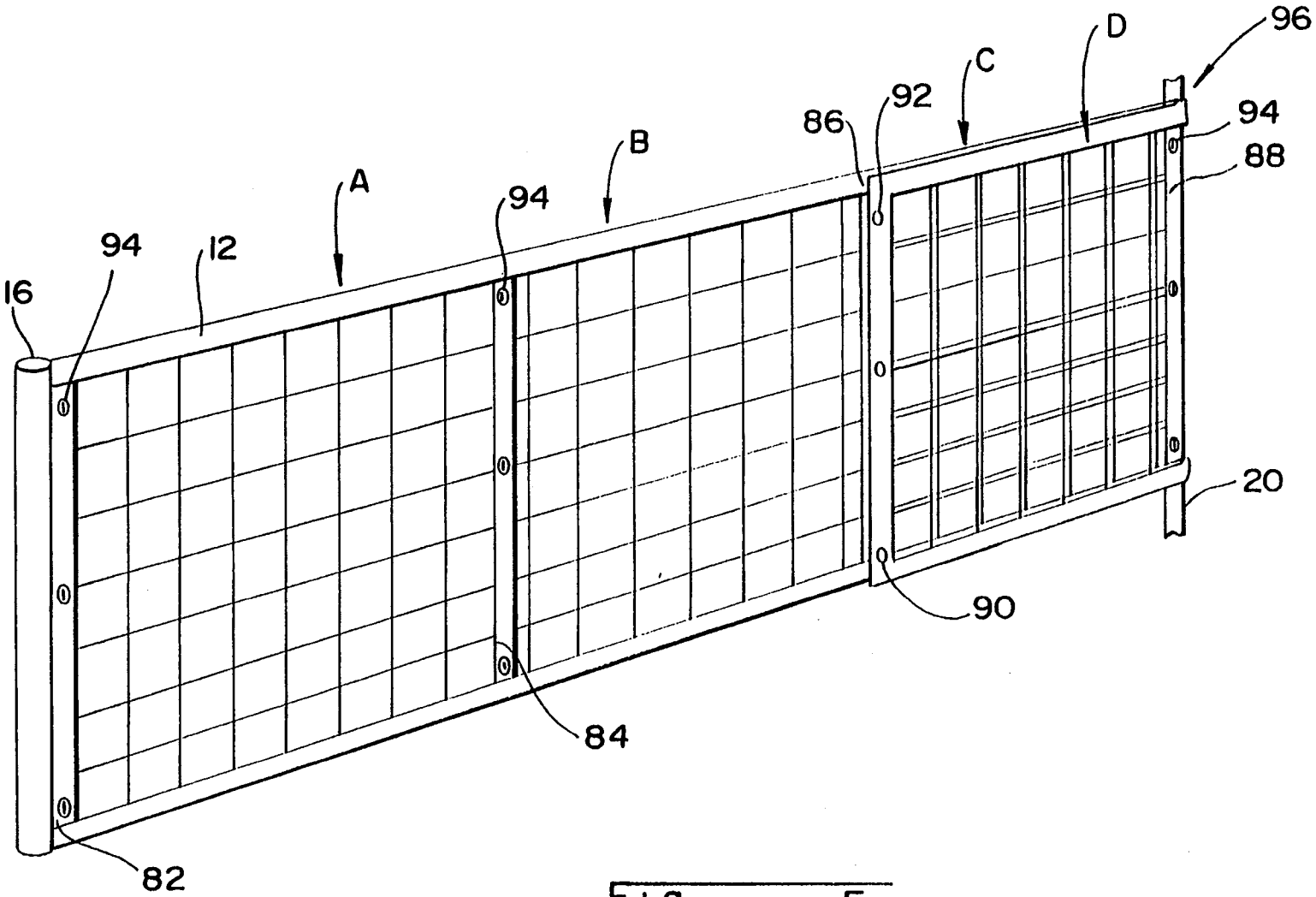
FIG. 5 is a perspective view of a fourth embodiment of the adjustable net of the present invention.

A fourth embodiment of the adjustable net of the present invention is illustrated in FIG. 5. Net 10 includes, for example, four sections A, B, C, and D, which each may be 7½ feet in length. Vertical tapes 82, 84, 86, 88, and 90 define the edges of the respective sections. A plurality of latches 92 are mounted on vertical tape 90, which is at the opposite end of the net from sleeve 16. Cooperating latching elements 94 are mounted on vertical tapes 82, 84, 86, and 88 for cooperation and latching engagement with latches 92.

Accordingly as illustrated in FIG. 5, section D may be folded against section C so that latches 92 engage latching elements 94 on vertical tape 86, so that the length of the net is 22½ feet. Similarly, if latches 92 engage the latching elements on vertical tape 84 or 82, the length of the net would be 18 feet and 15 feet, respectively.

Any known latching elements and latches may be used to secure the various vertical tapes to one another. For example, the latches may be rotating latches extending into openings in latching elements. Moreover, latches may be provided on vertical tapes 82–88 and latching elements may be provided on vertical tape 90.

It is further noted that the right end of the net, as illustrated in FIG. 5, may be attached to a net post 20 by loop 96, which is formed by folding the sections, so that the loop may extend around the net post.

Figure 6:
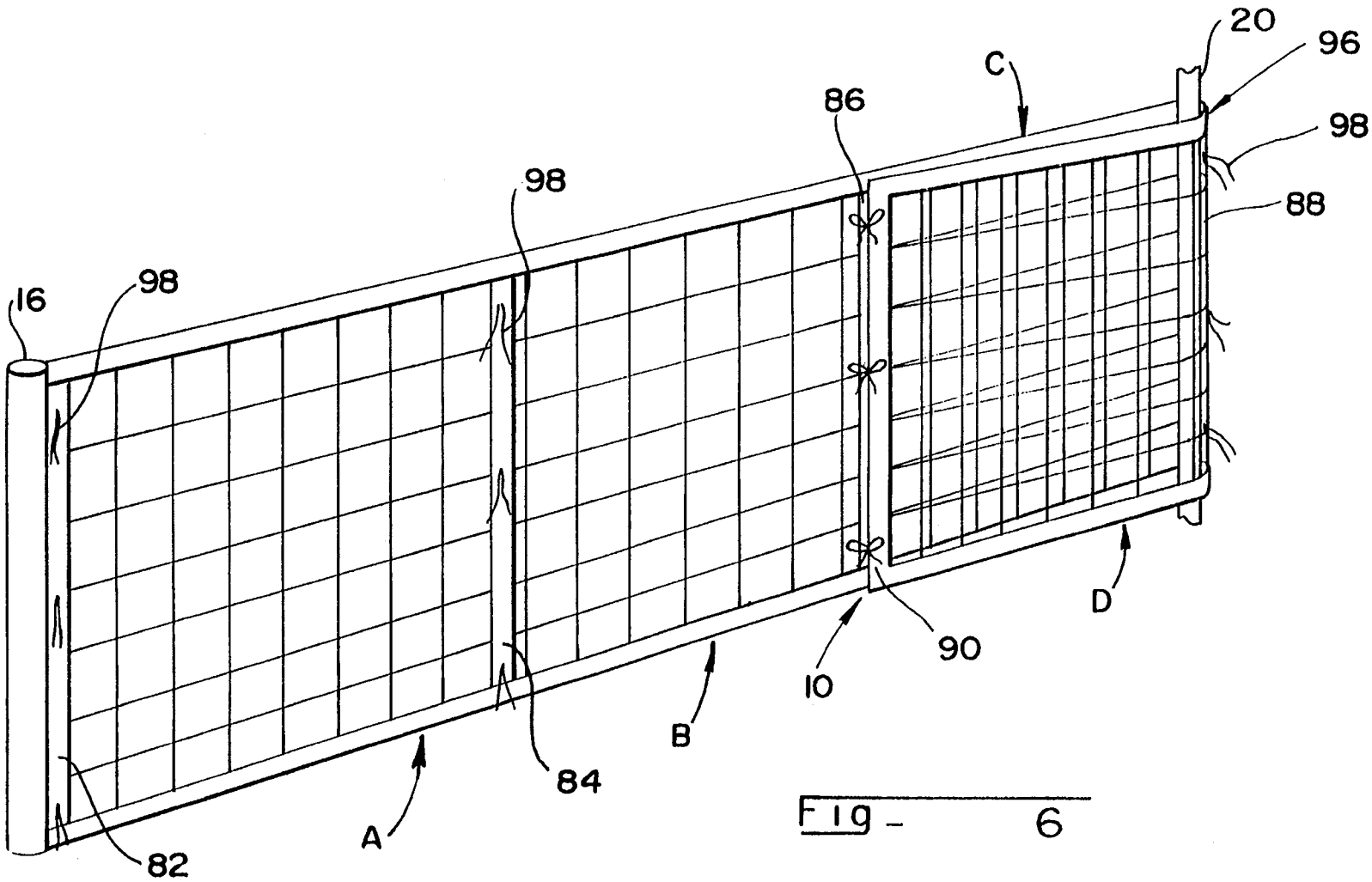
FIG. 6 is a perspective view of a fifth embodiment of the adjustable net of the present invention.

The fifth embodiment illustrated in FIG. 6, is similar to that illustrated in FIG. 5, except that string ties 98 are used as fastening elements instead of latches 92 and latching elements 94. Accordingly, the adjustable operation of the embodiment of FIG. 6 is substantially the same as described for FIG. 5, and may include using loop 96 to attach the net to a net post 20.

Figure 7:
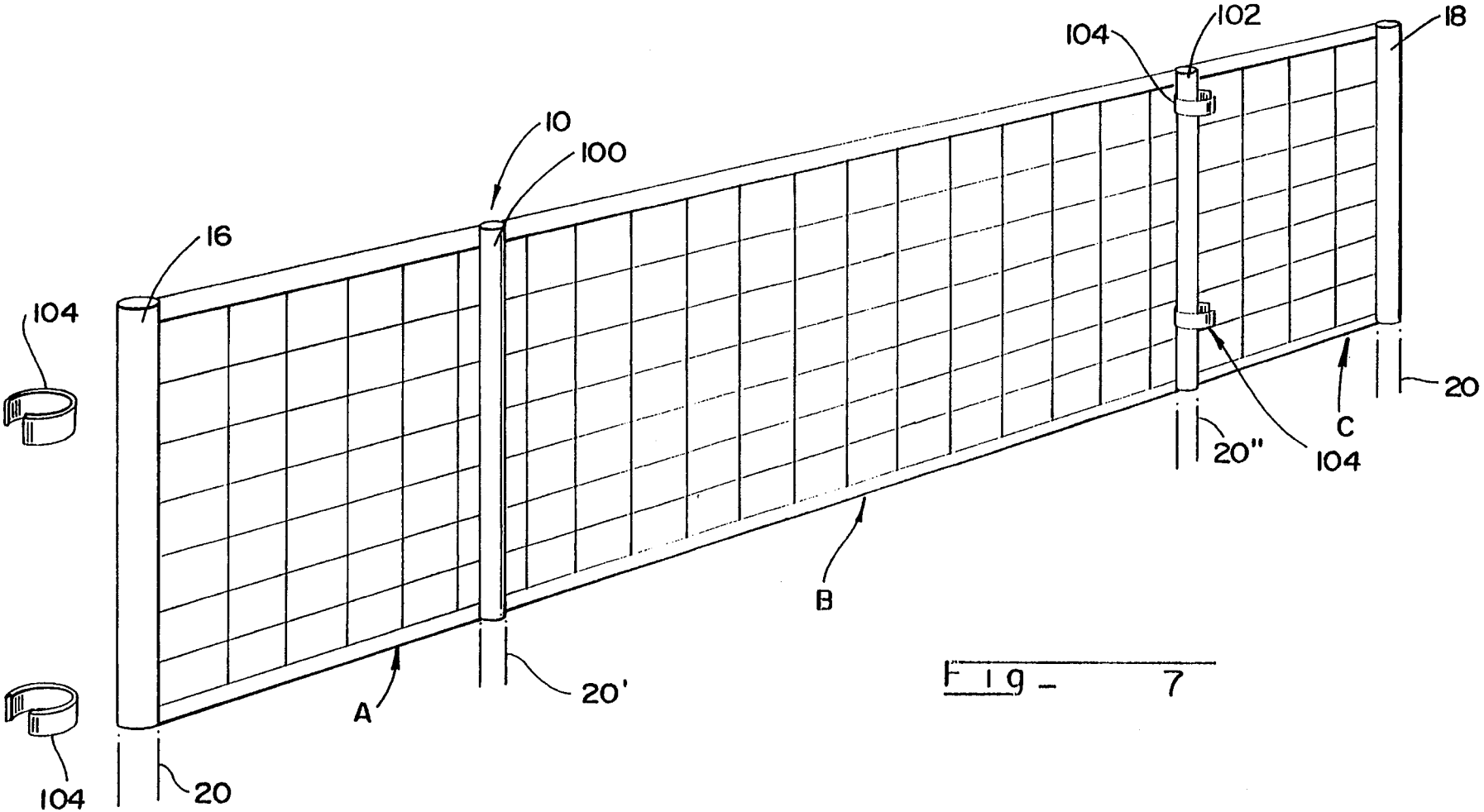
FIG. 7 is a perspective view of a sixth embodiment of the adjustable net of the present invention.

A sixth embodiment of the adjustable net of the present invention is illustrated in FIG. 7. Net 10 includes sections A, B, and C and sleeves at right and left ends thereof for attachment over respective net posts 20. Net 10 also includes auxiliary sleeves 100, 102 which may be attached over other net posts 20', 20'', respectively Straps 104 are illustrated as being connected to sleeve 102. Straps 104 include a fastener for securing the ends thereof together. Such fastener may be, for example, a known hook and loop fastener or a known snap fastener. Alternatively, the straps need not be connected to the sleeve or net or may be sewed or otherwise fastened to the net itself.

In operation, sleeves 16, 18, 100, and 102 may be selectively used in any combination. When sleeves 100 and/or 102 are used, the portion of the net between sleeves 16 and 100 and sleeves 18 and 102, respectively may be rolled and fastened by straps 104.

As an example, sections A and C may be 6 feet in length and section B may be 18 feet long. Therefore, when sleeves 16 and 18 are used, the net would be 30 feet long; when sleeves 16 and 102 are used, the net would be 24 feet long; and when sleeves 100 and 102 are used the net would be 18 feet long.

Advantageously, at least sleeves 100 and 102 may be made of a clear material, such as vinyl, so as not to block the vision of the players during a game.

Figure 8:
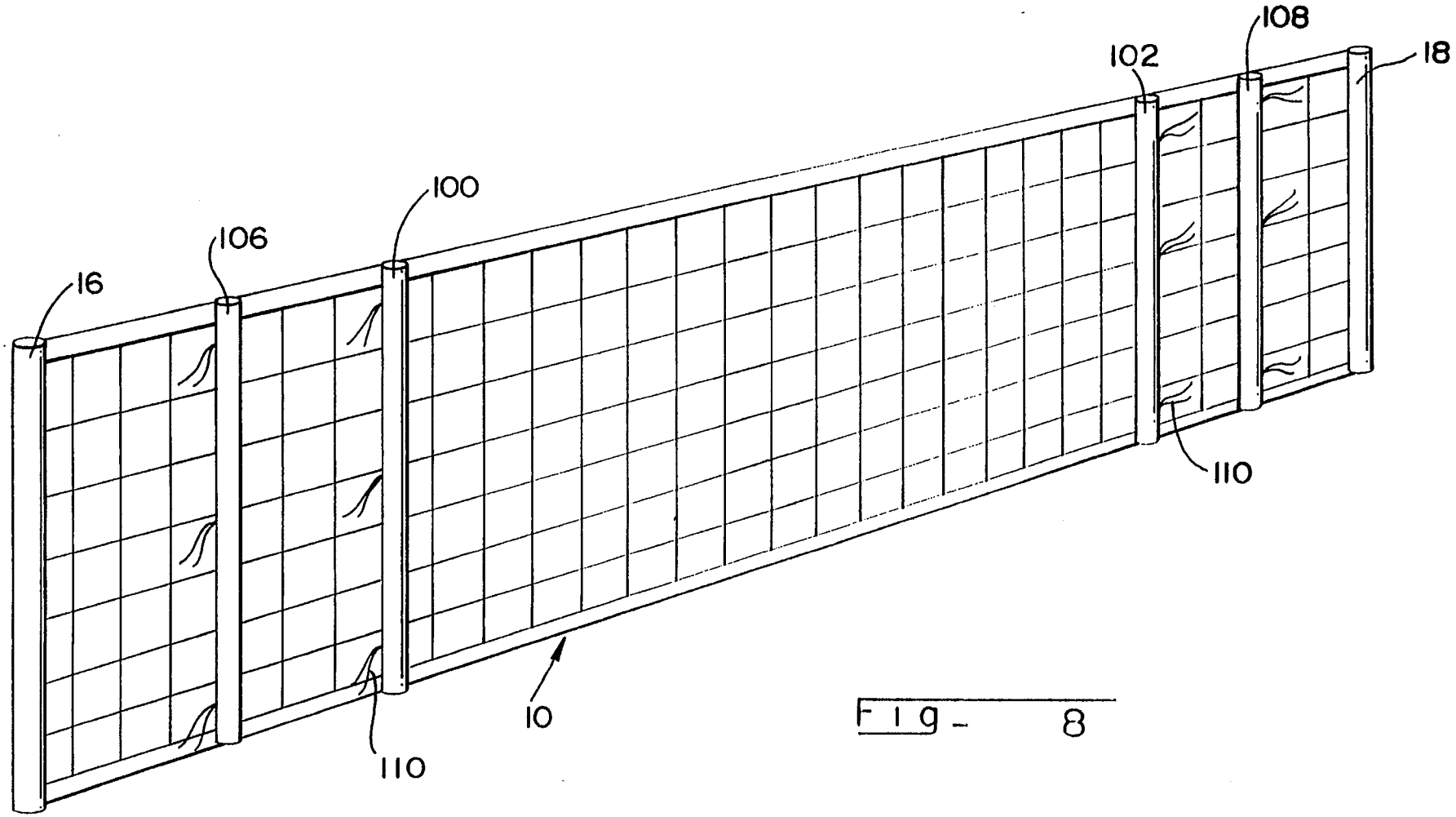
FIG. 8 is a perspective view of a seventh embodiment of the adjustable net of the present invention.

A seventh embodiment of the adjustable net of the present invention is illustrated in FIG. 8. This embodiment is similar to the sixth embodiment of FIG. 7, except that additional auxiliary sleeves 106 and 108 are placed between sleeves 16 and 100 and 18 and 102, respectively. Also, string ties 110 are used to secure the excess rolled up material instead of the straps 104 of FIG. 7. The operation of the seventh embodiment is essentially the same as that described with respect to the sixth embodiment of FIG. 7.

Figure 9:
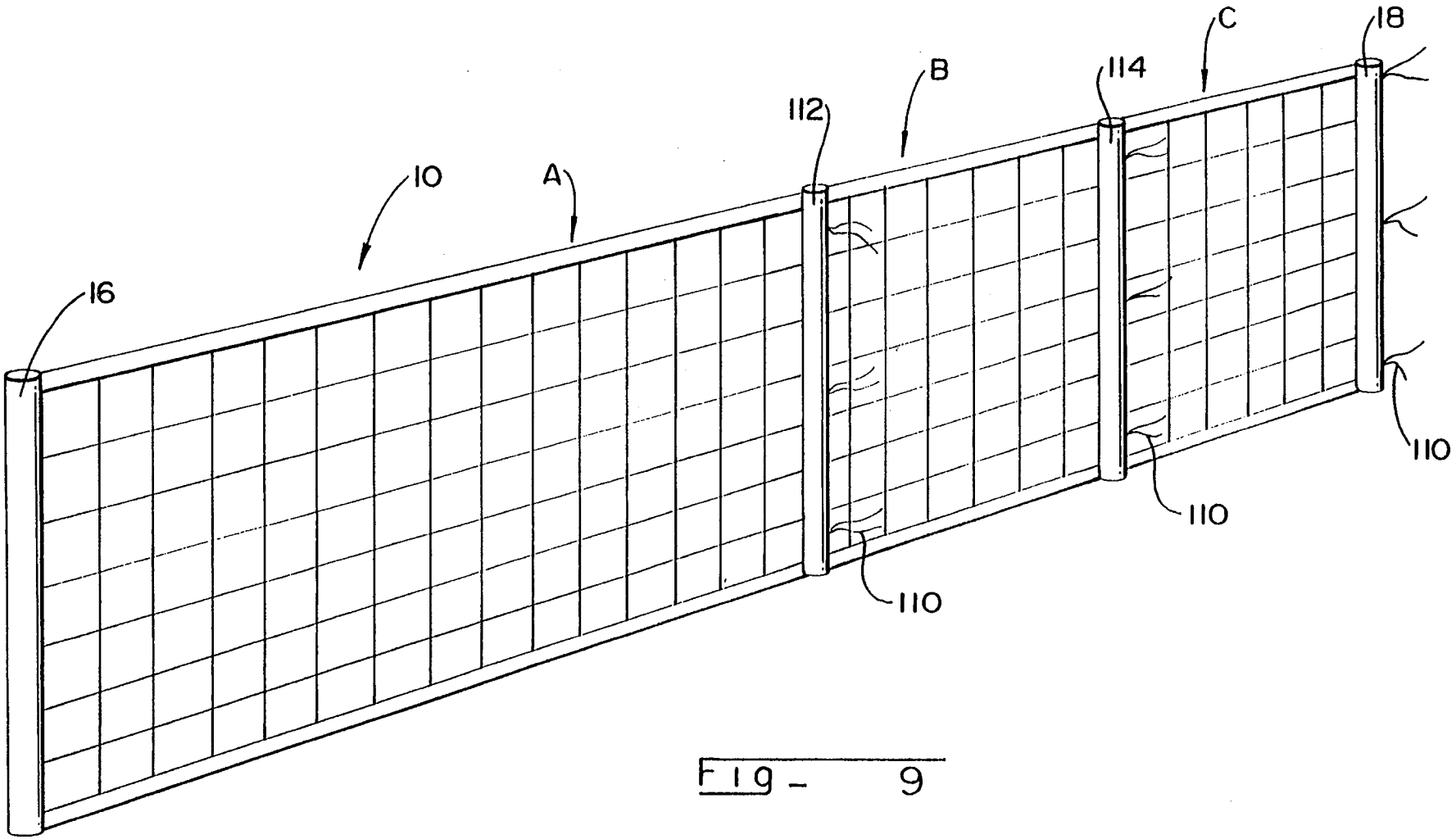
FIG. 9 is a perspective view of an eight embodiment of the adjustable net of the present invention.
Figure 10:
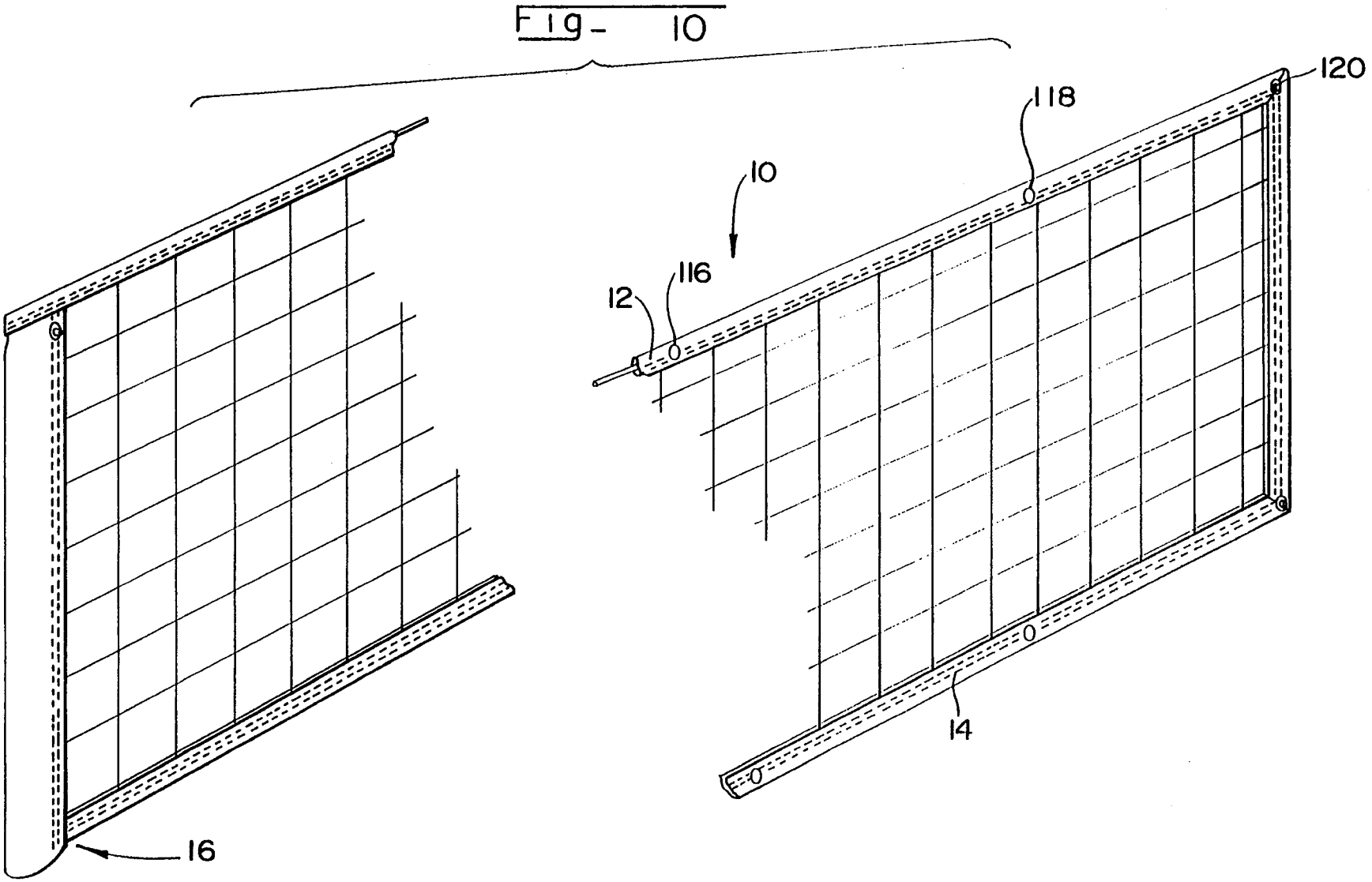
FIG. 10 is a perspective view of a net useable with a ninth embodiment of the adjustable net of the present invention.

An eighth embodiment of the adjustable net is illustrated in FIG. 9. This embodiment is similar to the embodiment of FIG. 8, except that auxiliary sleeves 112 and 114 are only located towards the left side of net 10 as viewed in FIG. 9.

Net 10 includes three sections A, B, and C. As an example, section. A has a length of 15 feet and sections B and C each have a length of 7½ feet. Accordingly, sections B and C can be folded instead of being rolled as in the embodiments of FIGS. 7 and 8. That is, if section C is folded against section B and sleeve 18 is fastened by string ties 110 on sleeves 18 and 112, the length of the net would be 22½ feet. If both sections B and C are folded against section A and sleeve 18 is fastened to sleeve 16, the length of the net would be 15 feet.

A ninth embodiment of the adjustable net of the present invention is illustrated in FIGS. 10, 11, and 12A–12C. Net 10 includes a fixed sleeve 16 at one end thereof and grommets 116, 118, and 120 spaced along top tape 12. Of course, corresponding grommets may also be located on bottom tape 14. As an example, grommets 116, 118, and 120 may be spaced from sleeve 16 by 15 feet, 22 feet, and 30 feet, respectively.

A detachable sleeve 122 is illustrated in FIG. 11. Sleeve 122 includes sleeve portion 124, grommets 126, 128 at the top and bottom portions, respectively, of sleeve portion 124. Snap hooks 130 and 132 are inserted in grommets 126 and 128, respectively. Of course, any other fastening elements, such as tie strings, may be used instead of either one or both of snap hooks 130, 132.

Figure 12A:
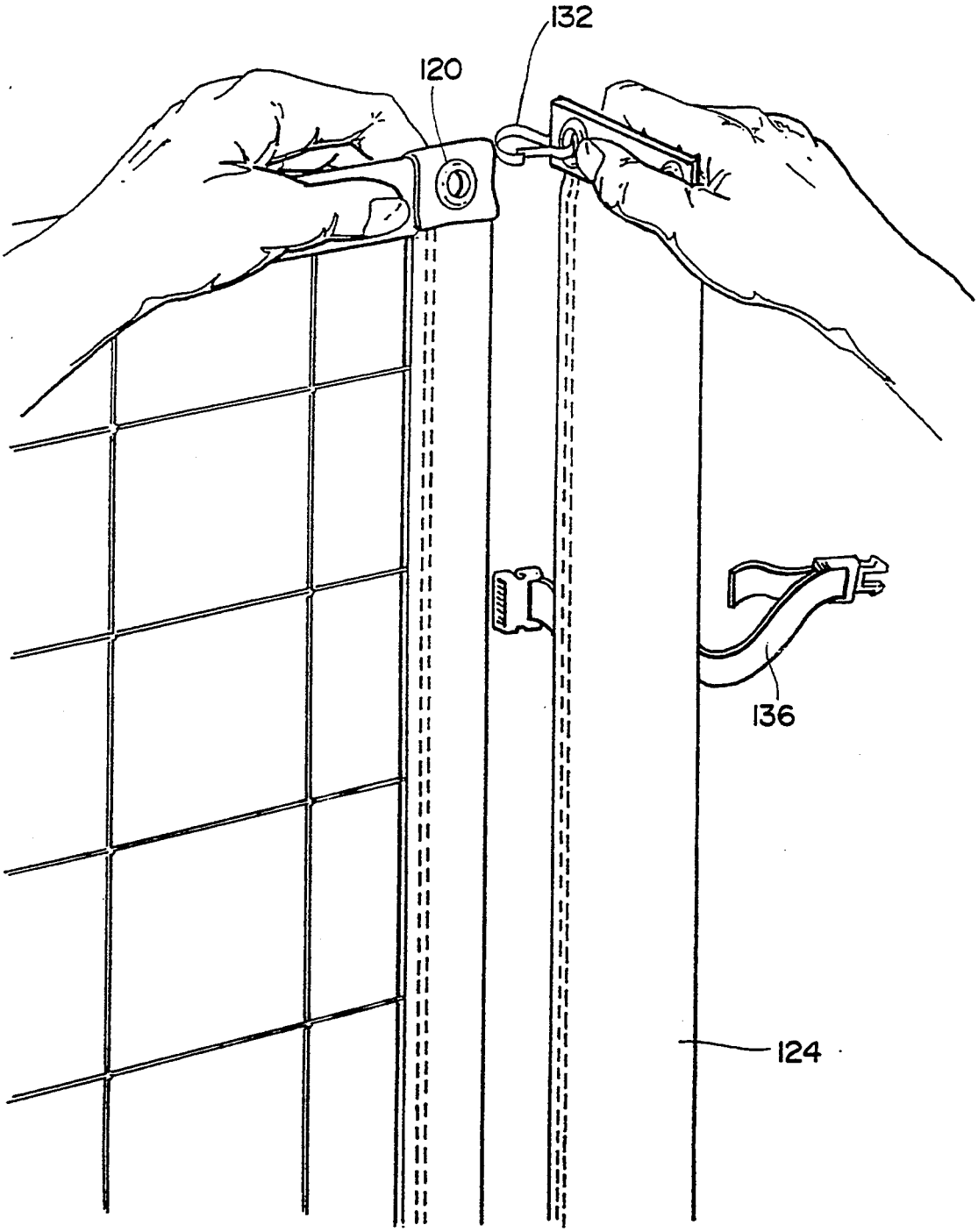
FIGS. 12A–12C illustrate the operation of the adjustable net and sleeve of FIGS. 10 and 11.

The operation of the net and sleeve 122 is explained with reference to FIGS. 12A–12C. If the full length of net 10 is desired, sleeve 122 is attached to the net by inserting snap hooks 130, 132 into grommets 120 and sleeve portion 124 is placed on the respective net post as shown in FIG. 12A.

Figure 12B:
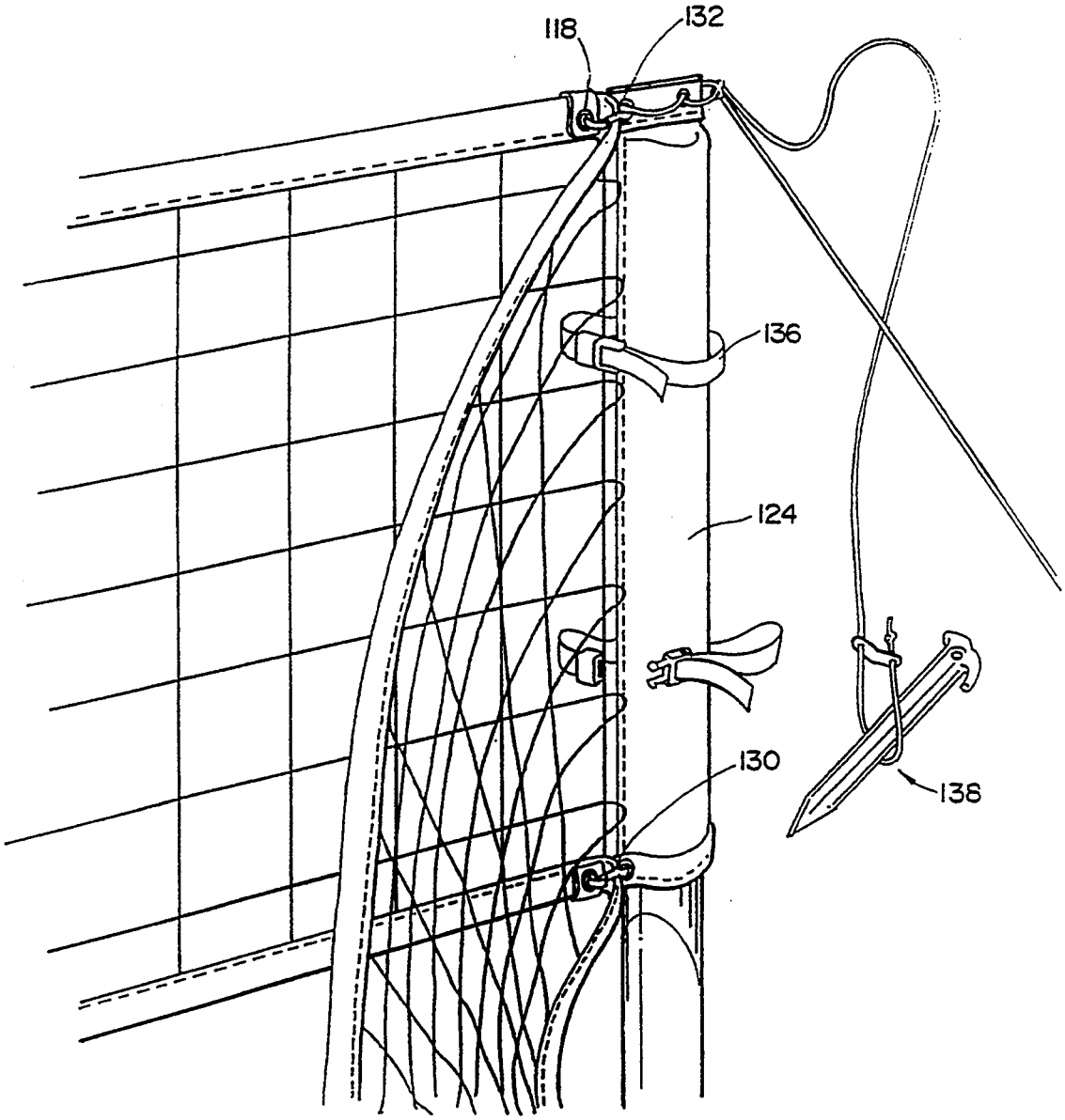
Figure 12C:
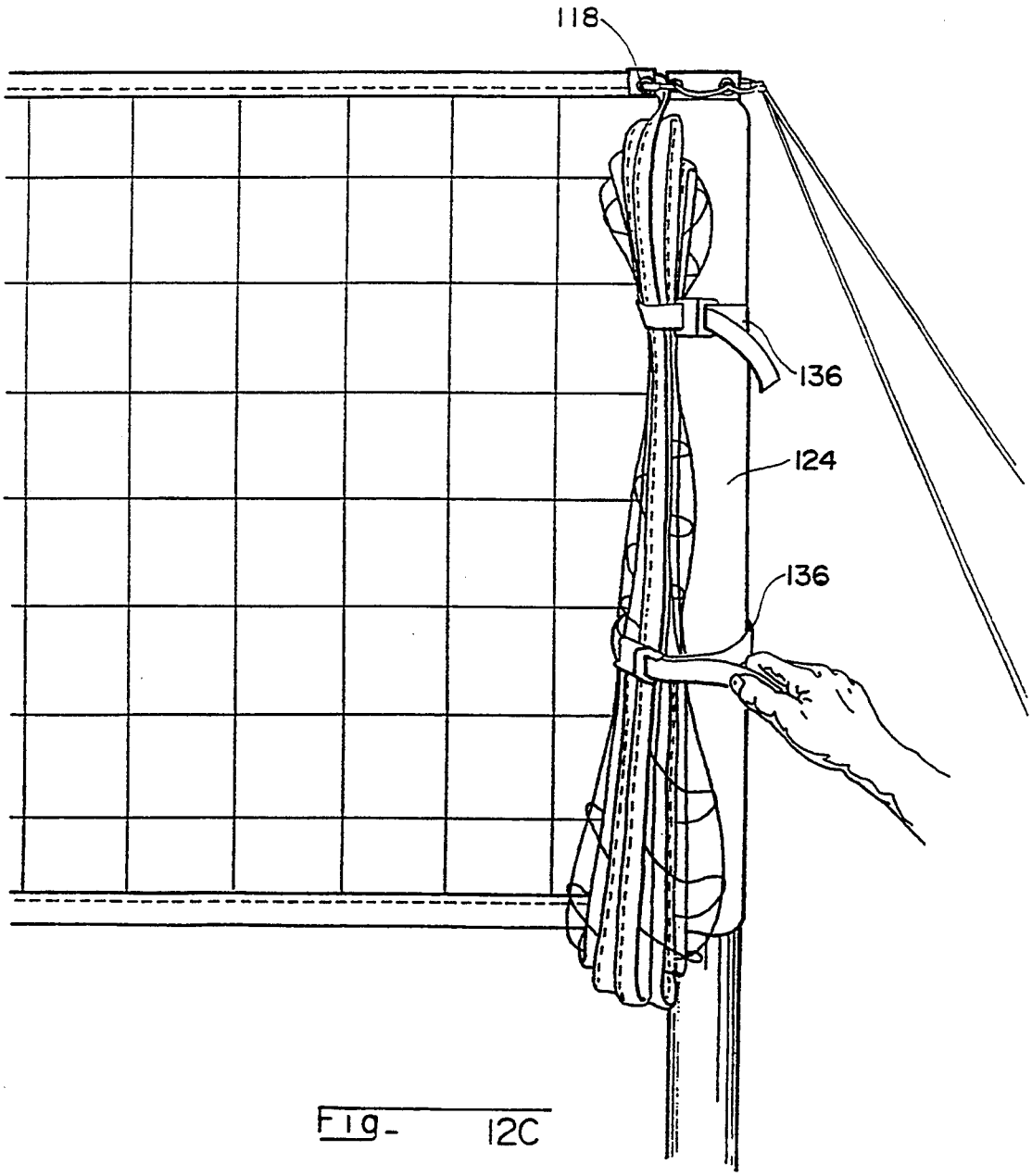

If a shortened length of the net is desired, snap hooks 130, 132 are inserted into grommets 116 or 118 and sleeve portion 124 is placed on the net post as illustrated in FIG. 12B. The excess net is then folded and secured by net straps 134 and fastening straps 136 as shown in FIG. 12C. Tension may then be applied by anchoring system 138.

Figure 14:
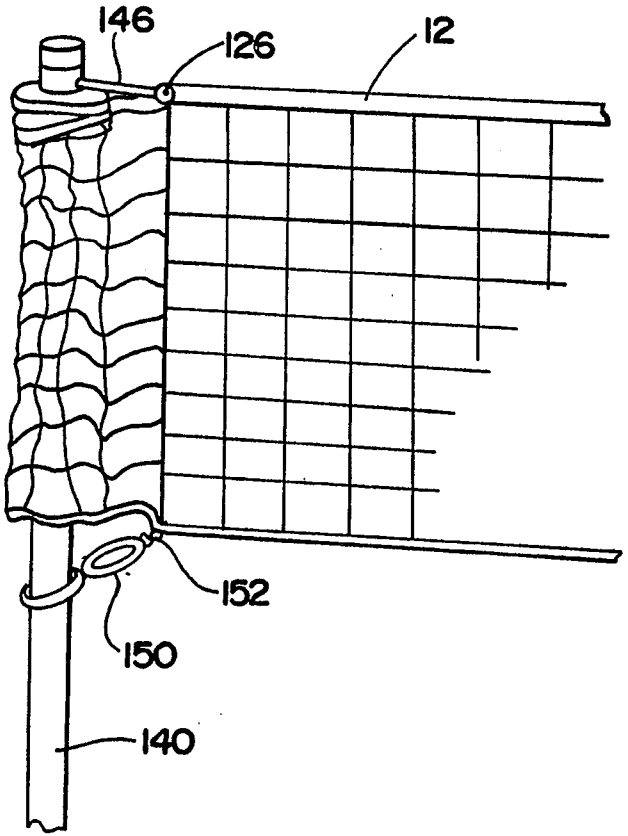
FIG. 14 is a view similar to FIG. 13 with the net being rolled on a net post.
Figure 15B:
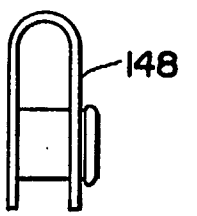
FIGS. 15A and 15B illustrate snaps useable with the embodiment of FIGS. 13 and 14.
Figure 15A:
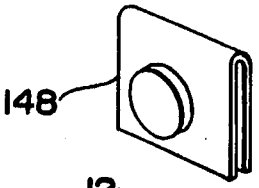
Figure 16:
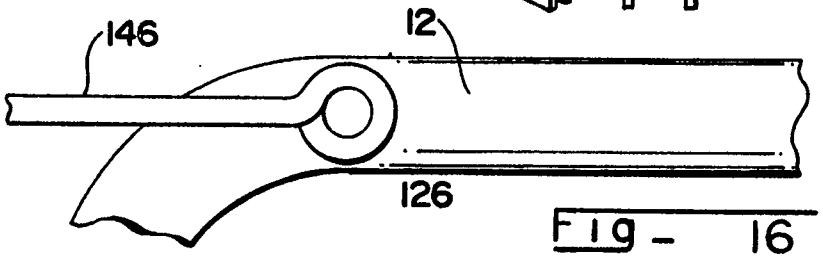
FIG. 16 illustrates the attachment of the net to an eye bolt.
Figure 13:
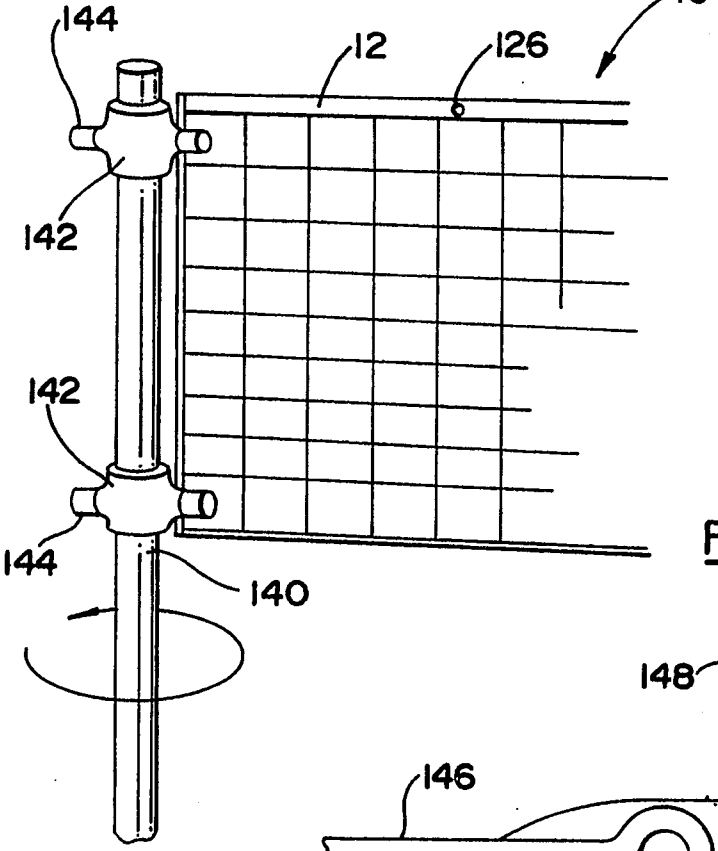
FIG. 13 is a partial perspective view of a tenth embodiment of the adjustable net of the present invention.

A tenth embodiment of the adjustable net of the present invention is illustrated in FIGS. 13–16. Referring to FIG. 13, net post 140 is adapted to rotate about a vertical axis as shown by the arrow. Net 10 may be wound about the pole upon rotation as illustrated in FIG. 14. Guides 142 are mounted on post 140 so that guide arms 144 may extend into the openings formed by the horizontal and vertical elements of the net, so that the net is evenly rolled on the post. Net 10 includes spaced grommets 126 on upper tape 12, such as described in the embodiment of FIG. 10.

When the net is rolled to its desired length, a snap fastener 148 is inserted through the openings in eye bolt 146 and grommet 126 to secure upper tape 12 to post 140. As illustrated in FIG. 14, one ring of double O-ring 150 is placed around post 140 and the other ring is attached to S-hook 152 which is in turn attached to the bottom of the net to apply tension to the net.

Figure 17:
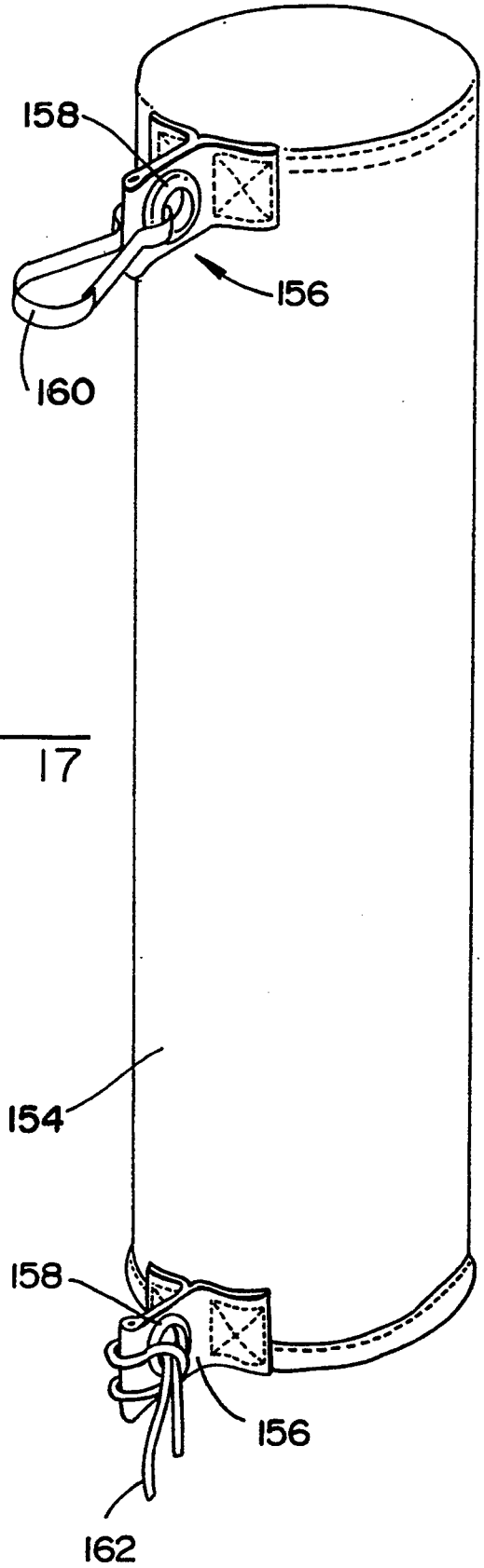
FIG. 17 is a perspective view of a sleeve which may be used with various nets.

A sleeve 154 is illustrated in FIG. 17, which may be used with,. for example, the nets of FIGS. 3, 5, and 6, or may be used with any net. Sleeve 154 is placed around a net post and includes straps 156, which may be made of nylon. Grommets 158 are mounted on straps 156. Either snap hooks 160 or tie strings 162 extend through the grommets and are attached to the net.

Figure 18:
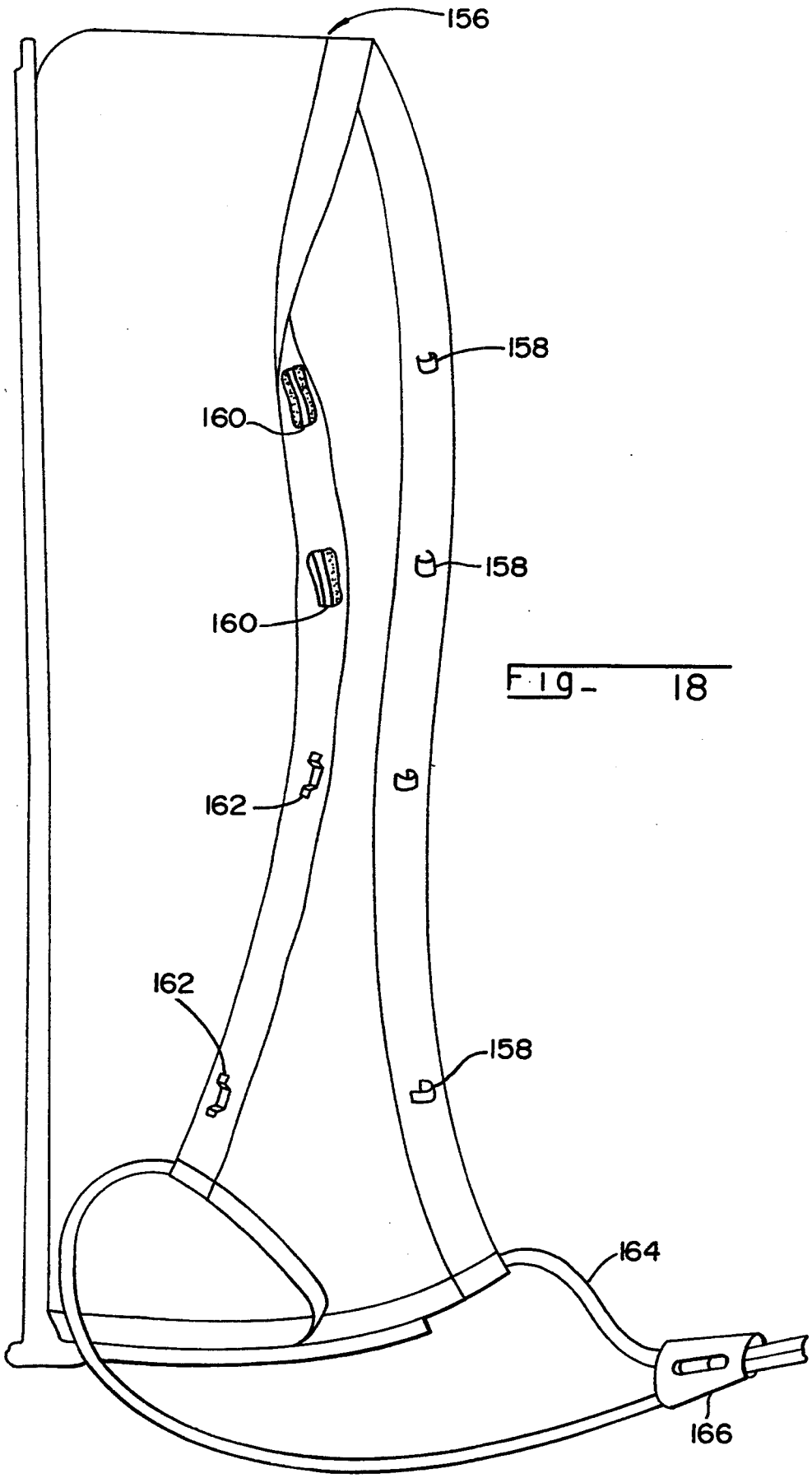
FIGS. 18, 19, and 20 illustrate embodiments of a shroud, which covers an end portion of a net and a support post.
Figure 19:
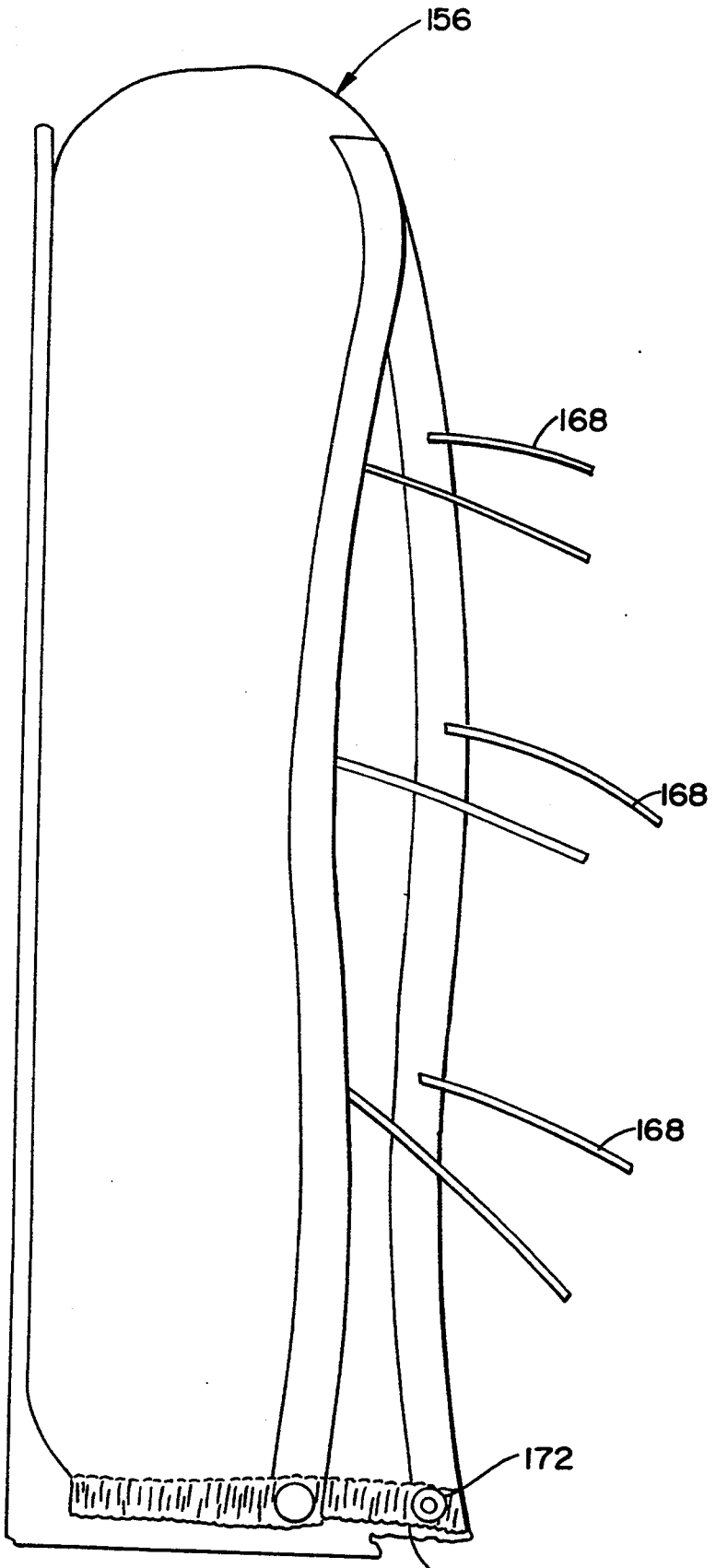
Figure 20:
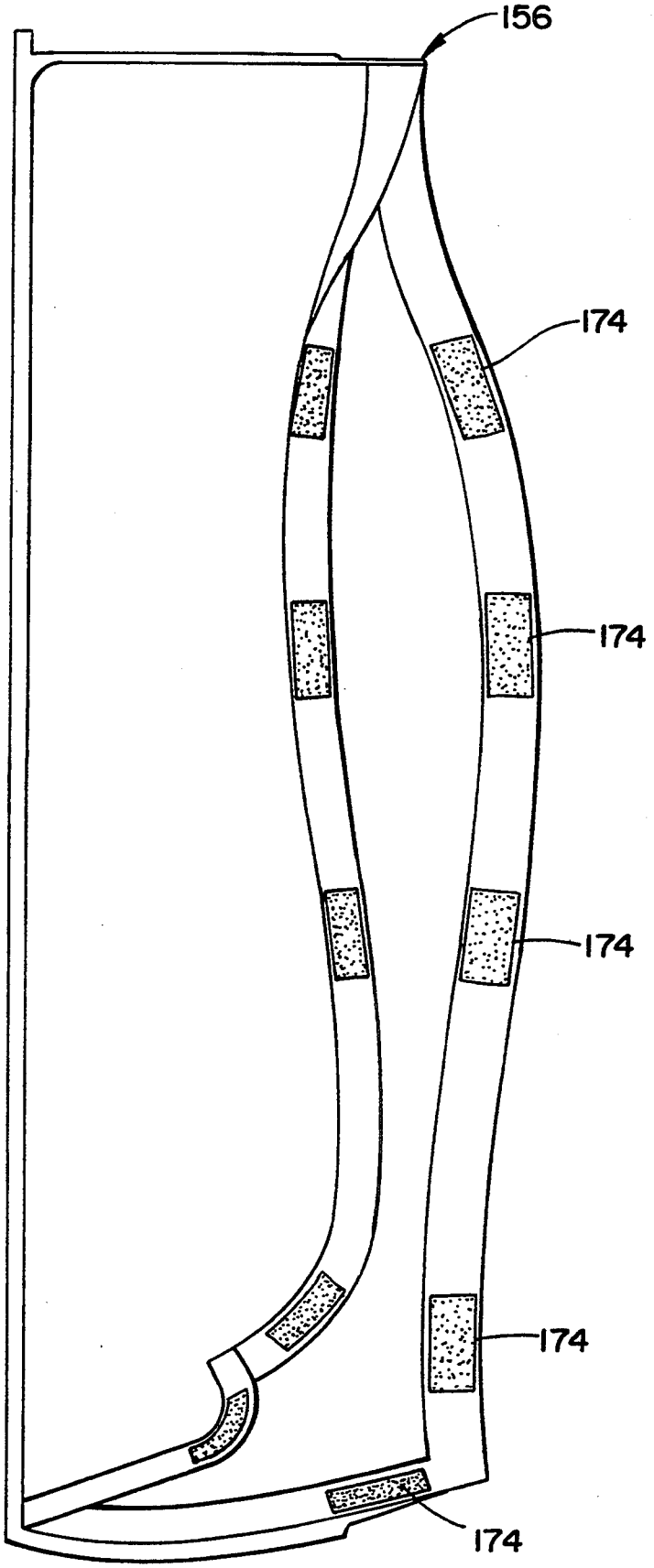

FIGS. 18, 19, and 20 illustrate various embodiments of a shroud, which covers and protects any excess net resulting from shortening the net.

As shown in FIG. 18, shroud 156 includes hooks 158, which may be fastened to either string loops 160, clips 162, or any other suitable fastening element, to secure the shroud around the net post and any folded or rolled excess net, such as illustrated, for example, in FIG. 12. Shroud 156 may also include pull string 164 and closure 166 to tighten the bottom of the shroud around the net post.

FIG. 19 illustrates a similar shroud as in FIG. 18, except that tie closures 168 are used instead of the hooks, and elastic bottom 170 tightens the bottom of the shroud around the net post and is secured by snap fastener 172, or any other suitable fastener.

FIG. 20 illustrates another shroud which utilizes conventional hook and loop fasteners, such as VELCRO to secure the shroud around the net post and any excess net material.

Figure 21:
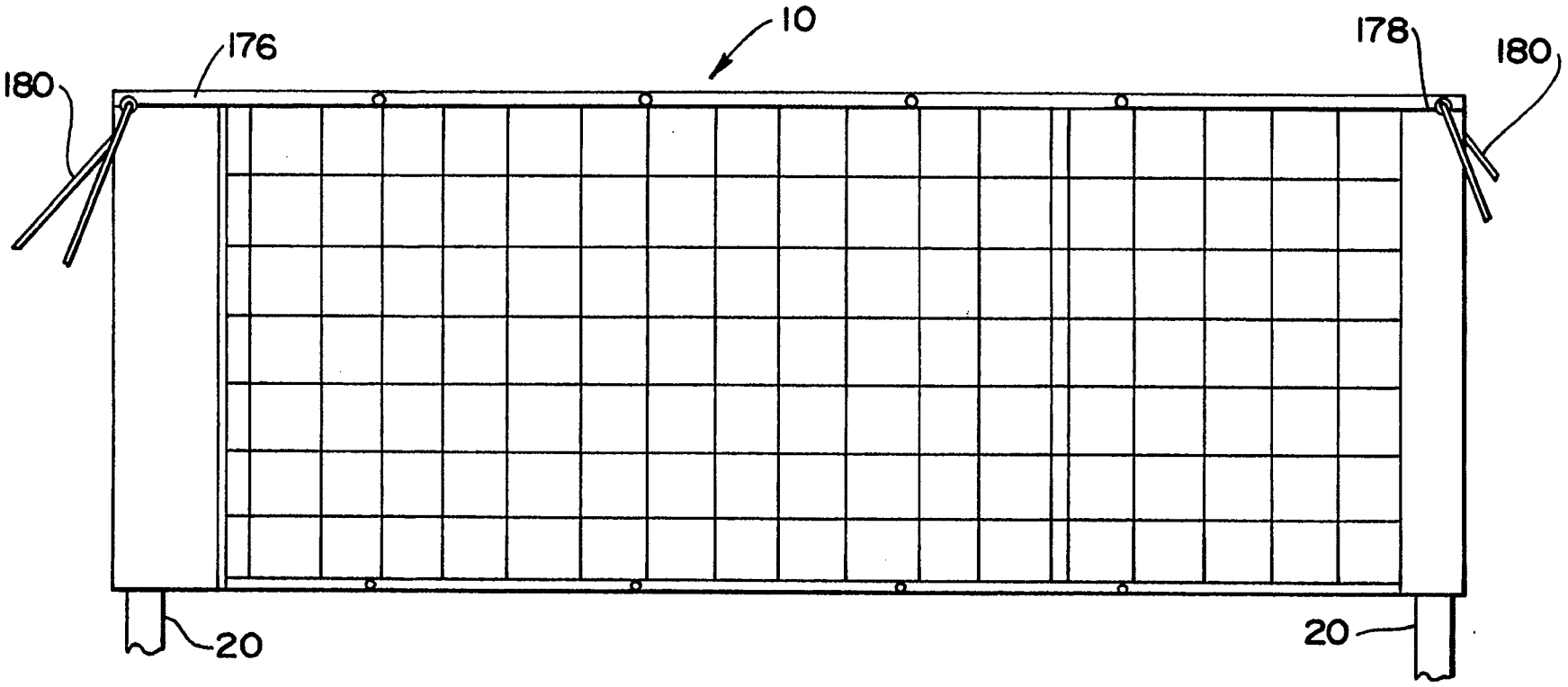
FIG. 21 illustrates a net having shrouds attached to the respective end portions thereof.

FIG. 21 illustrates net 10 having shrouds 176 and 178 located at the respective ends thereof. Net 10 is connected to the respective net posts inside the shrouds and stabilizing lines 180 are attached through respective grommets at the top of the shrouds as illustrated in FIG. 21.

Figures 22, 23:
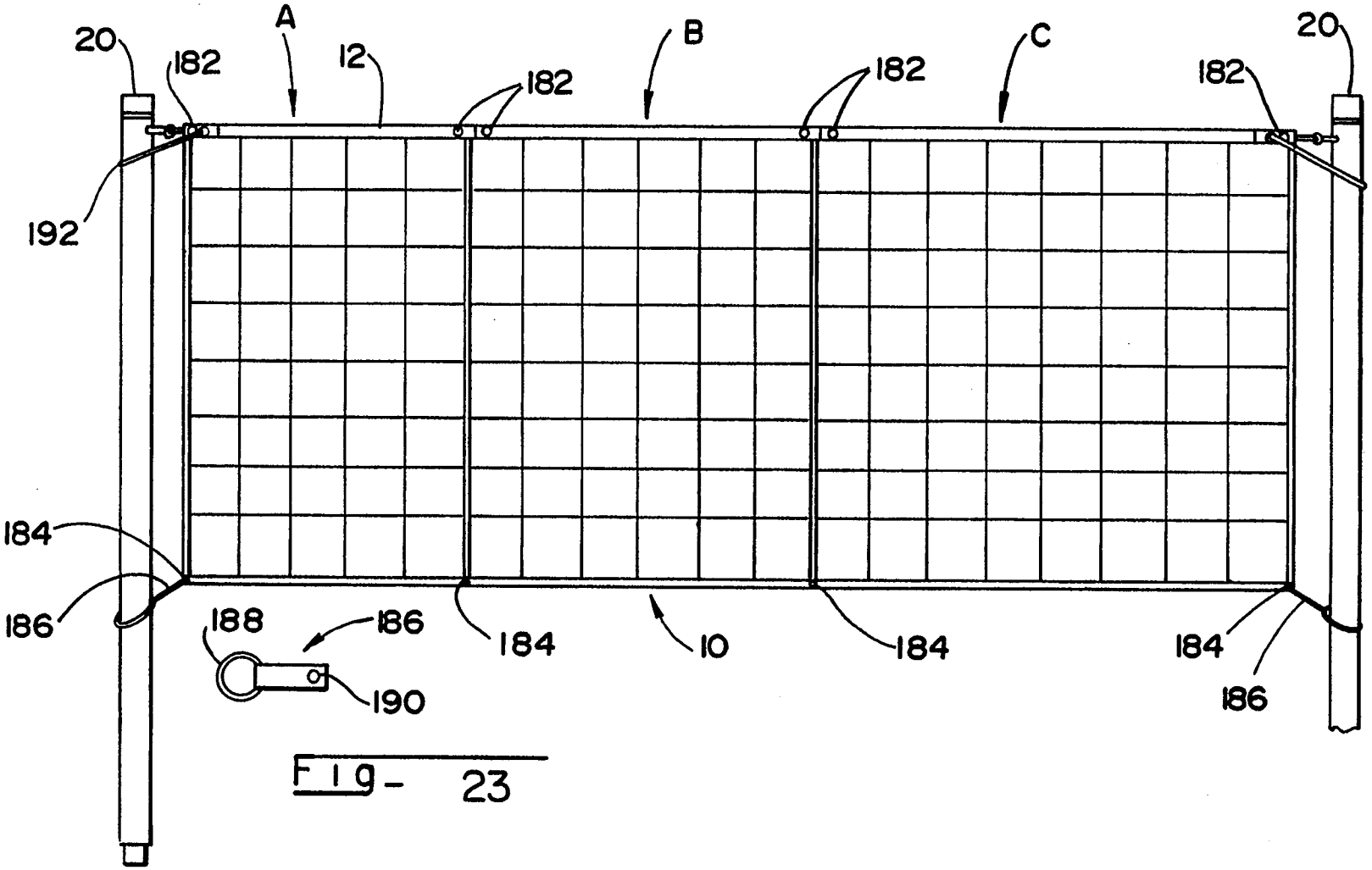
FIG. 22 illustrates an eleventh embodiment of the adjustable net of the present invention.
FIG. 23 illustrates a connecting ring.

FIG. 22 illustrates an eleventh embodiment of the present invention, wherein net 10 includes three sections A, B, and C. For example, Section A may be 7 feet long, section B may be 10 feet long, and section C may be 15 feet long. Of course, any number of sections and any length of the respective sections may be used. Sections A–C may be used individually or in any combination to achieve the desired length.

Grommets 182 are located along top tapes of each section for attachment to net posts 20 in a conventional manner. Complementary snap fasteners 184 are located along vertical portions of each section to fasten any section to another section. Bottom fastener 186 includes an O-ring 188 at one end and a snap fastener at the other end. O-ring 188 is placed around net post 20 and snap 190 is fastened to the appropriate snap 184 to apply tension to the bottom of the net. Stabilizing ring 192 may also be utilized at the top of the net to apply tension thereto.

Figure 24:
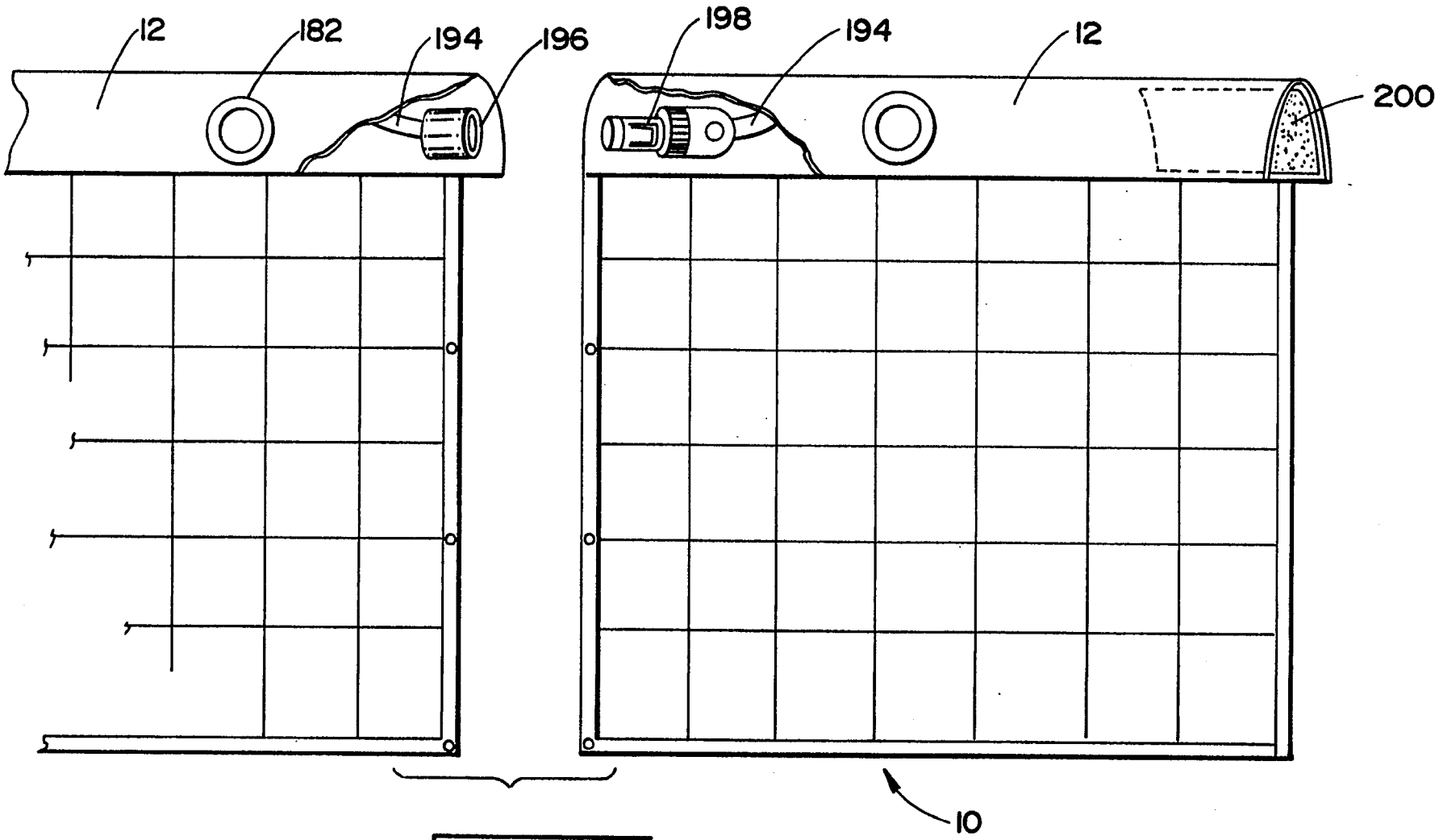
FIG. 24 illustrates the net of FIG. 22 with net sections being separated.

As illustrated in FIG. 24, tension lines 194 extend through top tapes 12. These lines may either extend from both ends of each section, or one end of a line may be secured by rivets. Tension lines 194 include complementary connection elements 196, 198 at respective ends to adjacent lines when adjacent sections are connected. It is also possible to eliminate tension lines 194 and use hook and loop strips 200 to connect top tapes 12.

In the example illustrated in FIG. 22, if sections A, B, or C are each used individually, the overall length of the net would be 7, 10, or 15 feet, respectively. Sections A and B would result in a length of 17 feet; Sections A and C would result in a length of 22 feet; sections B and C would result in a length of 25 feet; and sections A, B, and C would result in a length of 32 feet.

Figures 25, 26, 27, 28, 29:
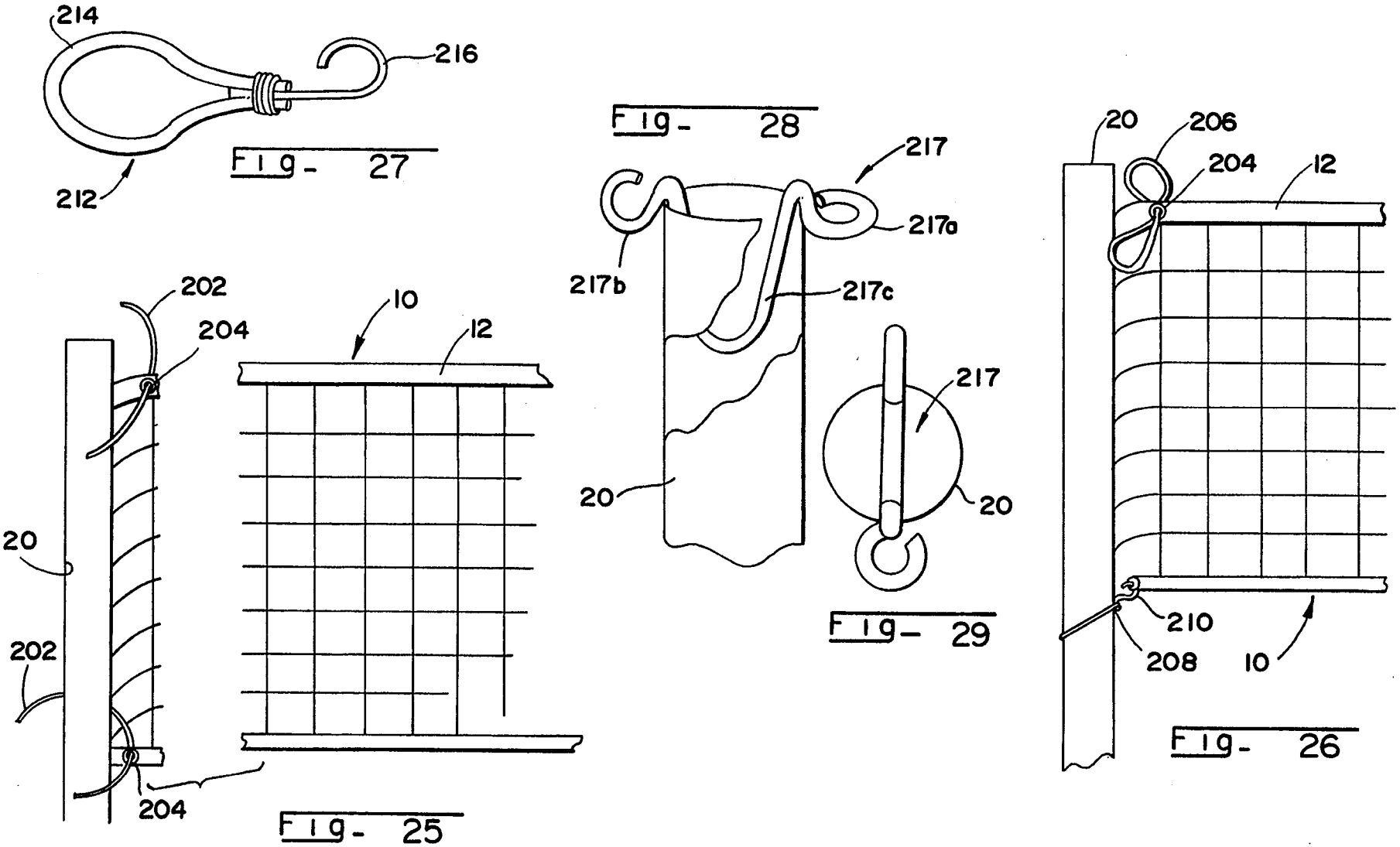
FIGS. 25, 26, and 27 illustrate various embodiments for connecting a net to net posts.
FIG. 28 illustrates a net attaching element connected to a net post.
FIG. 29 is a plan view of the net attaching element of FIG. 28.
Figure 30:
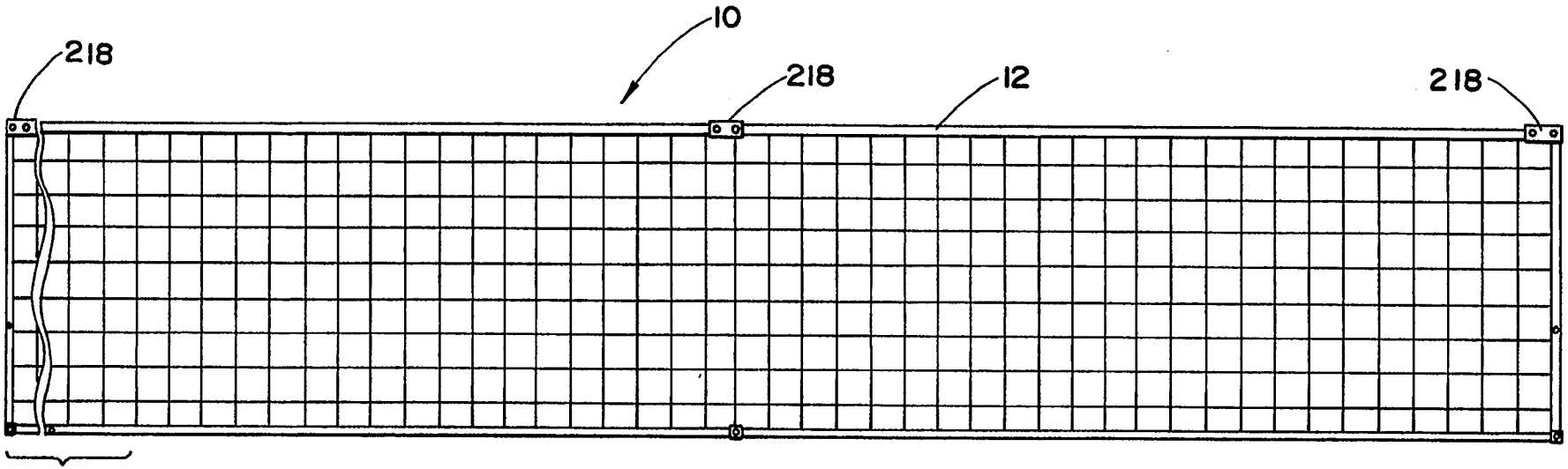
FIG. 30 illustrates a net having a line tensioning element.

As illustrated in FIG. 25, tie strings 202 may extend through grommets 204 and around net post 20 to attach net 10 to the net post.

FIG. 26 shows O-ring 206 extending through grommet 204, thereby forming two loops which extend around net post 20. The bottom of the net is attached to net post 20 by O-ring 208, which extends around the net post and is attached to the net by S-hook 210.

FIG. 27 illustrates another attachment element 212 which may be attached to either the top or bottom of the net and includes ring 21.4, which extends around the net post and J-hook 216, which is attached to the net.

An attaching element 217 is illustrated in FIGS. 28 and 29. Net attachment element 217 comprises a wire having hooks **217*a* and 217*b* at each end thereof, which are joined by a resilient wire element 217*c*. Element 217*c* extends into an upper opening in net post 20 and is held therein. One of hooks 217*a* and 217*b*** may then be attached to the net and the other hook is attached to a conventional anchoring system.

Figures 31, 32, 33, 34:
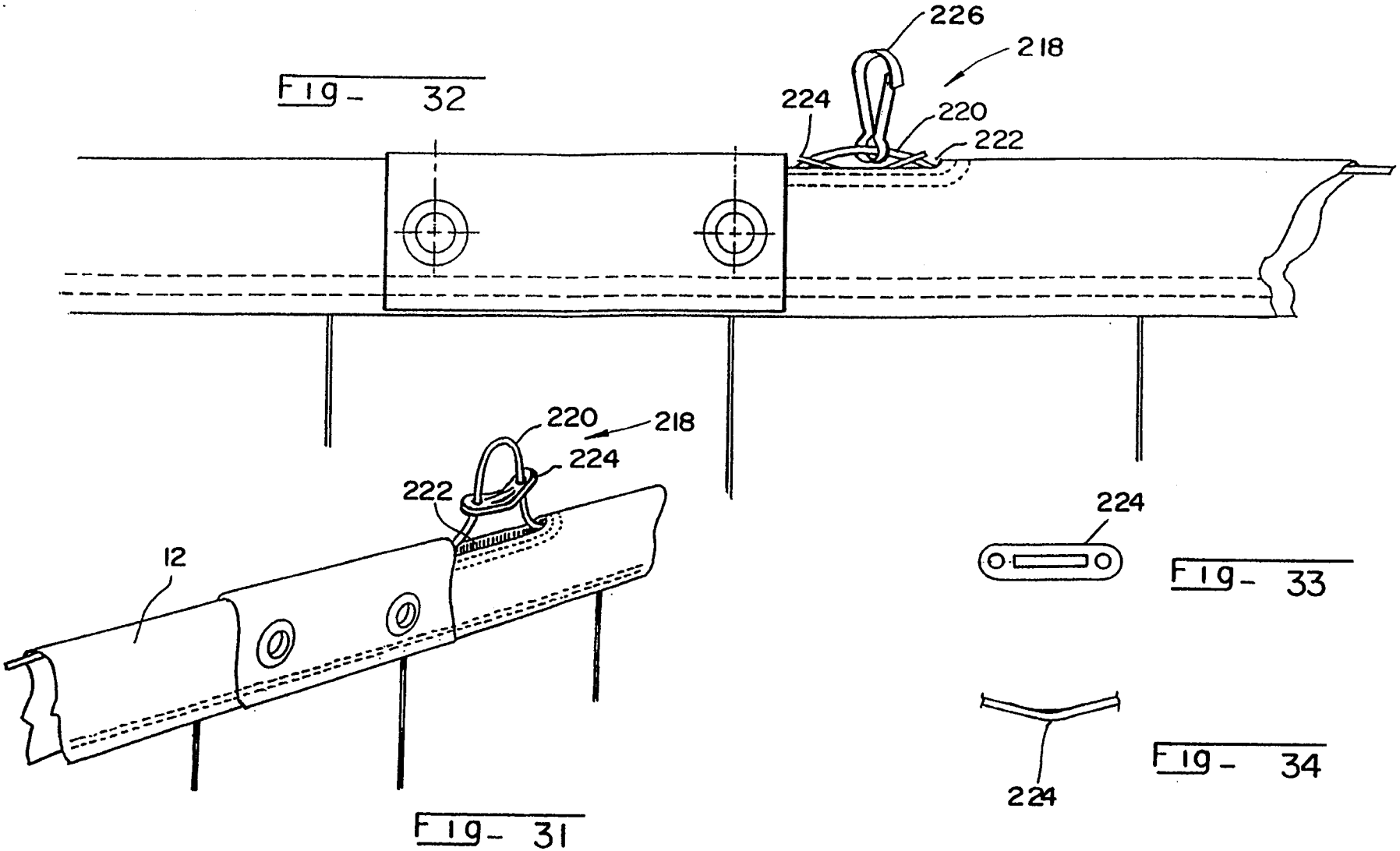
FIG. 31 is a perspective view of the line tensioning element of FIG. 30.
FIG. 32 is an enlarged view of the line tensioning element of FIG. 30.
FIG. 33 is a plan view of a tension clip usable with the line tensioning element of FIG. 30.
FIG. 34 is an elevation view of the tension clip of FIG. 33.

A net with tensioning elements is illustrated in FIGS. 30–34. Tensioning elements 218 are located at intervals on top tape 12 of the net. As shown in FIGS. 31 and 32, each tensioning element includes line 220 extending along the length of top tape 12. Top tape 12 includes openings 222, through which a portion of line 220 may protrude. Line 220 extends through holes in tension clips 224 in the areas of the openings. Line 220 also extends through hook fastener 226 between the holes of tension clip 224 as illustrated in FIG. 32. In operation, line 220 is pulled out of openings 222 the desired amount to tension the net, and hooks 225 are fastened to the bottom edge of top tape 12 to hold line 220 in the desired position.

Although the invention has been described with reference to particular means, materials and embodiments, it is to be understood that the invention is not limited to the particulars disclosed and extends to all equivalents within the scope of the claims.

What is claimed is:

1. An adjustable net for attachment to external net posts, said adjustable net comprising:

an elongated net having a fully extended length, a top edge and a bottom edge, a first side edge and a second side edge, at least one securing means at at least one different position along the length of the net between said first side edge and said second side edge, a first attachment element at said first side edge for attachment to an external net support; and a sleeve selectively attachable at said second side edge and at a selected one of said securing means at different positions along the length of said net, said sleeve being attachable to an external net support.

2. The adjustable net according to claim 1, further comprising at least one fastening element on said sleeve to hold excess net when said sleeve is at one of said different positions along the length of said net.

3. The adjustable net according to claim 2, wherein said at least one fastening element comprises at least one net strap.

4. The adjustable net according to claim 1, wherein said at least one securing means comprises grommets on at least one of said top edge and said bottom edge of said net, and a fastening means attached to said sleeve for extending through a respective grommet.

5. The adjustable net-according to claim 4, wherein said fastening means comprises a snap hook.

6. An adjustable net for attachment to external net posts, said adjustable net comprising:

an elongated net having a fully extended length, a top edge and a bottom edge, a first side edge and a second side edge, at least one securing means at at least one different position along the length of the net between said first side edge and said second side edge, a first attachment element at said first side edge for attachment to an external net support;

a second attachment element selectively attachable at said second side edge and at a selected one of said securing means at different positions along the length of said net, said second attachment element being attachable to an external net support; and at least one fastening element on said second attachment element to hold excess net when said second attachment element is at one of said different positions along the length of said net.

7. The adjustable net according to claim 6, wherein said at least one fastening element comprises at least one strap.

8. An adjustable net for attachment to external net posts, said adjustable net comprising:

an elongated net having a fully extended length, a top edge and a bottom edge, a first side edge and a second side edge, at least one securing means at at least one different position along the length of the net between said first side edge and said second side edge, a first attachment element at said first side edge for attachment to an external net support;

a second attachment element selectively attachable at said second side edge and at a selected one of said securing means at different positions along the length of said net, said second attachment element being attachable to an external net support; and wherein said at least one securing means comprises grommets on at least one of said top edge and said bottom edge of said net, and a fastening means attached to said second attachment element for extending through a respective grommet, said fastening means comprising a snap hook.

* * * * *